US008493163B2

(12) United States Patent
Kubo et al.

(10) Patent No.: US 8,493,163 B2
(45) Date of Patent: Jul. 23, 2013

(54) BANDPASS FILTER, WIRELESS COMMUNICATION MODULE AND WIRELESS COMMUNICATION DEVICE

(75) Inventors: Takanori Kubo, Kirishima (JP); Hiromichi Yoshikawa, Kirishima (JP)

(73) Assignee: Kyocera Corporation, Kyoto (JP)

( * ) Notice: Subject to any disclaimer, the term of this patent is extended or adjusted under 35 U.S.C. 154(b) by 880 days.

(21) Appl. No.: 12/567,693

(22) Filed: Sep. 25, 2009

(65) Prior Publication Data

US 2010/0013577 A1 Jan. 21, 2010

Related U.S. Application Data

(63) Continuation-in-part of application No. PCT/JP2008/053701, filed on Feb. 29, 2008.

(30) Foreign Application Priority Data

Mar. 27, 2007 (JP) ..... 2007-082459
Sep. 27, 2007 (JP) ..... 2007-251575

(51) Int. Cl.
*H01P 1/203* (2006.01)
*H01P 7/08* (2006.01)

(52) U.S. Cl.
USPC ..... 333/204; 333/4; 333/219

(58) Field of Classification Search
USPC ..... 333/4, 202, 204, 219
See application file for complete search history.

(56) References Cited

U.S. PATENT DOCUMENTS 5,376,908 A * 12/1994 Kawaguchi et al. ..... 333/203
5,519,366 A * 5/1996 Kaneko et al. ..... 333/204
6,420,942 B1 * 7/2002 Hiroshima et al. ..... 333/26

* cited by examiner

*Primary Examiner* — Benny Lee
*Assistant Examiner* — Gerald Stevens
(74) *Attorney, Agent, or Firm* — Birch, Stewart, Kolasch & Birch, LLP

(57) ABSTRACT

A bandpass filter for a wide frequency band such as UWB is disclosed. The bandpass filter can receive a pair of signals, namely a balanced signal, and output a pair of signals. The bandpass filter comprises a plurality of ½ wavelength resonance electrodes, a plurality of ¼ wavelength resonance electrodes and a plurality of coupling electrodes. A transmission characteristic of the bandpass filter having flat and low loss over the entire region of the broad pass band can be achieved.

8 Claims, 17 Drawing Sheets

BANDPASS FILTER, WIRELESS COMMUNICATION MODULE AND WIRELESS COMMUNICATION DEVICE

CROSS-REFERENCE TO RELATED APPLICATION

The present application is a continuation in part based on PCT Application No. JP2008/053701, filed on Feb. 29, 2008, which claims the benefit of Japanese Application No. 2007-082459, filed on Mar. 27, 2007, and Japanese Application No. 2007-251575, filed on Sep. 27, 2007 both entitled "BANDPASS FILTER, RADIO COMMUNICATION MODULE AND RADIO COMMUNICATION DEVICE USING SAME". The contents of which are incorporated by reference herein in their entirety.

FIELD OF THE INVENTION

Embodiments of the present invention relate generally to bandpass filters, and more particularly relate to a bandpass filter for a wide frequency band.

BACKGROUND

In recent years, an Ultra Wide Band (UWB) has drawn attention as a new communication means. UWB transmits amounts of data using a broad frequency band over a short distance such as 10 m or 33 feets. A frequency band of 3.1 to 10.6 GHz, for example, is subjected to use for UWB according to the rule of U.S. FCC (Federal Communication Commission). As such, a feature of UWB is to utilize a broad frequency band. Japan and the ITU-R have a plan to introduce standards separated into a low band of about 3.1 to 4.7 GHz and a high band of about 6 GHz to 10.6 GHz to avoid a band of 5.3 GHz that is used in the IEEE802.11a standard. Accordingly, a low band filter requires the characteristic of being abruptly attenuated at 2.5 GHz and 5.3 GHz.

SUMMARY

A bandpass filter for a wide frequency band such as UWB is disclosed. The bandpass filter can receive a pair of signals, namely a balanced signal, and output a pair of signals. A transmission characteristic of the bandpass filter having flat and low loss over the entire region of the broad pass band can be achieved.

A first embodiment comprises a bandpass filter. The bandpass filter comprises a ground electrode on or in the laminate, a first ½ wavelength resonance electrode and a second ½ wavelength resonance electrode, a first ¼ wavelength resonance electrode, a second ¼ wavelength resonance electrode, a first input coupling electrode, a second input coupling electrode, a first output coupling electrode and a second output coupling electrode. The laminate comprises a plurality of dielectric layers. The a first ½ wavelength resonance electrode and a second ½ wavelength resonance electrode in a first inter-layer portion of the laminate are arranged in parallel with each other, and each has a strip shape. The a first ¼ wavelength resonance electrode is located between the first ½ wavelength resonance electrode and the second ½ wavelength resonance electrode in the first inter-layer portion of the laminate, has a strip shape, comprises a ground end and an open end, is parallel to a first half portion of the first ½ wavelength resonance electrode and a first half portion of the second ½ wavelength resonance electrode, and is sandwiched by the first half portion of the first ½ wavelength resonance electrode and the first half portion of the second ½ wavelength resonance electrode. The second ¼ wavelength resonance electrode is located between the first ½ wavelength resonance electrode and the second ½ wavelength resonance electrode in the first inter-layer portion of the laminate, has a strip shape, comprises a ground end and an open end, parallel to a second half portion of the first ½ wavelength resonance electrode and a second half portion of the second ½ wavelength resonance electrode, and is sandwiched by the second half portion of the first ½ wavelength resonance electrode and the second half portion of the second ½ wavelength resonance electrode. The first input coupling electrode is in a second inter-layer portion of the laminate has a strip shape, and faces the first half portion of the first ½ wavelength resonance electrode. The second input coupling electrode is in the second inter-layer portion of the laminate, and has a strip shape, facing the second half portion of the first ½ wavelength resonance electrode.

A second embodiment comprises a bandpass filter. The bandpass filter comprises a laminate, a ground electrode on or in the laminate, a first ½ wavelength resonance electrode, a second ½ wavelength resonance electrode, a first ¼ wavelength resonance electrode, a second ¼ wavelength resonance electrode, a third ¼ wavelength resonance electrode, a fourth ¼ wavelength resonance electrode, a first coupling electrode, a second coupling electrode, a third coupling electrode, a fourth coupling electrode and resonant electrode coupling conductor. The laminate comprises a plurality of dielectric layers. The a first ½ wavelength resonance electrode and a second ½ wavelength resonance electrode in a first inter-layer portion of the laminate are arranged in parallel with each other, and each has a strip shape and each comprises a first half portion including a first open end and a second half portion including a second open end. The first ¼ wavelength resonance electrode is located between the first ½ wavelength resonance electrode and the second ½ wavelength resonance electrode in the first inter-layer portion of the laminate, has a strip shape, and faces and is electromagnetically coupled to both the first half portion of the first ½ wavelength resonance electrode and the first half portion of the second ½ wavelength resonance electrode. The first ¼ wavelength resonance electrode comprises a first ground end and a third open end. The first ground end is closer to the first end of the first ½ wavelength resonance electrode and the first end of the second ½ wavelength resonance electrode than the third open end. The second ¼ wavelength resonance electrode is located between the first ½ wavelength resonance electrode and the second ½ wavelength resonance electrode in the first inter-layer portion of the laminate, has a strip shape, and faces and is electromagnetically coupled to both the second half portion of the first ½ wavelength resonance electrode and the second half portion of the second ½ wavelength resonance electrode. The second ¼ wavelength resonance electrode comprises a second ground end and a fourth open end. The second ground end is closer to the second end of the first ½ wavelength resonance electrode and the second end of the second ½ wavelength resonance electrode than the fourth open end. The third ¼ wavelength resonance electrode in the first inter-layer portion of the laminate is located at the other side of the first ¼ wavelength resonance electrode with respect to the first ½ wavelength resonance electrode, has a strip shape, and faces and is electromagnetically coupled to the first half portion of the first ½ wavelength resonance electrode. The third ¼ wavelength resonance electrode comprises a third ground end and a fifth open end. The third ground end is closer to the first end of the first ½ wavelength resonance electrode than the fifth open end. The fourth ¼ wavelength resonance electrode in the first inter-layer portion of the laminate is located at the other side of the second ¼ wavelength resonance electrode with respect to the first ½ wavelength resonance electrode, has a strip shape, and faces and is electromagnetically coupled to the second half portion of the first ½ wavelength resonance electrode. The fourth ¼ wavelength resonance electrode comprises a fourth ground end and a sixth open end, wherein the fourth ground end is closer to the second end of the second ½ wavelength resonance electrode than the sixth open end. The first coupling electrode in a second inter-layer portion of the laminate has a strip shape, faces the third ¼ wavelength resonance electrode, and comprises a first connection point which faces a part of a half portion of the first half portion of the first ½ wavelength resonance electrode at the open end side. The second coupling electrode in the second inter-layer portion has a strip shape, faces the fourth ¼ wavelength resonance electrode, and comprises a second connection point which faces a part of a half portion of the second half portion of the first ½ wavelength resonance electrode at the open end side. The third coupling electrode in the second inter-layer portion has a strip shape, faces the first half portion of the second ½ wavelength resonance electrode, and comprises a third connection point which faces a part of a half portion of the first half portion of the second ½ wavelength resonance electrode at the open end side. The fourth coupling electrode in the second inter-layer portion has a strip shape, face the second half portion of the second ½ wavelength resonance electrode, and comprises a fourth connection point which faces a part of a half portion of the second half portion of the second ½ wavelength resonance electrode at the open end side. The resonant electrode coupling conductor is in the third inter-layer portion of the laminate which is the opposite side of the second inter-layer portion with respect to the first inter-layer portion. The resonant electrode coupling conductor has a strip shape. The resonant electrode coupling conductor comprises a first coupling portion, a second coupling portion and a third coupling portion. The first coupling portion comprises a first end, which is connected to ground potential near the ground end of the third ¼ wavelength resonance electrode, and faces and is electromagnetically coupled to a part of a half portion of the third ¼ wavelength resonance electrode at the ground end side. The second coupling portion comprises a second end, which is connected to ground potential near the ground end of the fourth ¼ wavelength resonance electrode, and faces and is electromagnetically coupled to a part of a half portion of the fourth ¼ wavelength resonance electrode at the ground end side. The third coupling portion faces and electromagnetically coupled to at least a center part of the second ½ wavelength resonance electrode.

A third embodiment comprises a high frequency module. The high frequency module comprises a RF module comprising a bandpass filter mentioned above, and a base band module connected to the RF module.

A fourth embodiment comprises a radio communication device. The radio communication device comprises a RF module comprising a bandpass filter mentioned above, a base band module connected to the RF module and an antenna connected to the bandpass filter.

BRIEF DESCRIPTION OF THE DRAWINGS

Embodiments of the present invention are hereinafter described in conjunction with the following figures, wherein like numerals denote like elements. The figures are provided for illustration and depict exemplary embodiments of the invention. The figures are provided to facilitate understanding of the invention without limiting the breadth, scope, scale, or applicability of the invention. The drawings are not necessarily made to scale.

DETAILED DESCRIPTION OF EXEMPLARY EMBODIMENTS

The following description is presented to enable a person of ordinary skill in the art to make and use the embodiments of the disclosure. The following detailed description is exemplary in nature and is not intended to limit the disclosure or the application and uses of the embodiments of the disclosure. Descriptions of specific devices, techniques, and applications are provided only as examples. Modifications to the examples described herein will be readily apparent to those of ordinary skill in the art, and the general principles defined herein may be applied to other examples and applications without departing from the spirit and scope of the invention. Furthermore, there is no intention to be bound by any expressed or implied theory presented in the preceding technical field, background, brief summary or the following detailed description. The present disclosure should be accorded scope consistent with the claims, and not limited to the examples described and shown herein.

Embodiments of the disclosure are described herein in the context of practical non-limiting applications, namely, bandpass filters. Embodiments of the disclosure, however, are not limited to such bandpass filters, and the techniques described herein may also be utilized in other filter applications. For example, embodiments are not limited to a wide bandpass filter and may be applicable to a high frequency module, radio communication device, and the like.

As would be apparent to one of ordinary skill in the art after reading this description, these are merely examples and the embodiments of the disclosure are not limited to operating in accordance with these examples. Other embodiments may be utilized and structural changes may be made without departing from the scope of the exemplary embodiments of the present disclosure.

Figure 1:
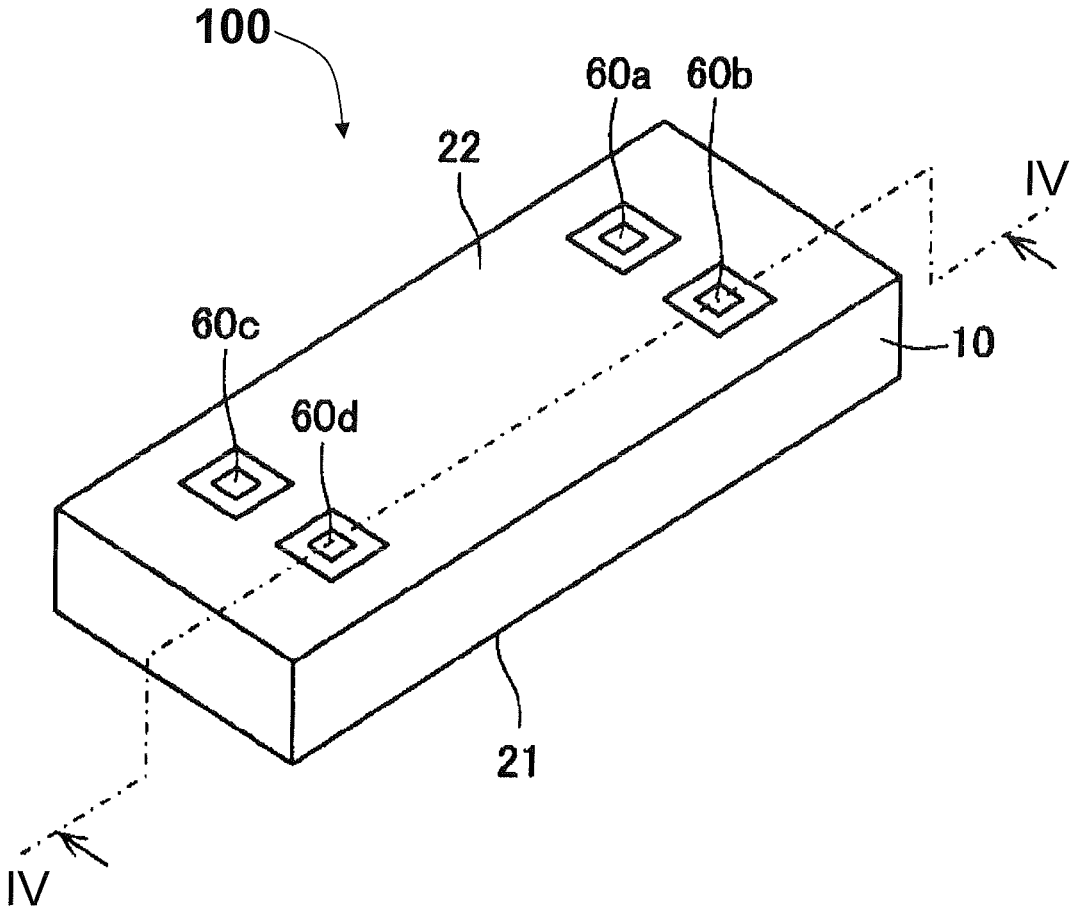
FIG. 1 is a perspective view schematically illustrating the external appearance of a bandpass filter according to one embodiment of the present invention.
Figure 2:
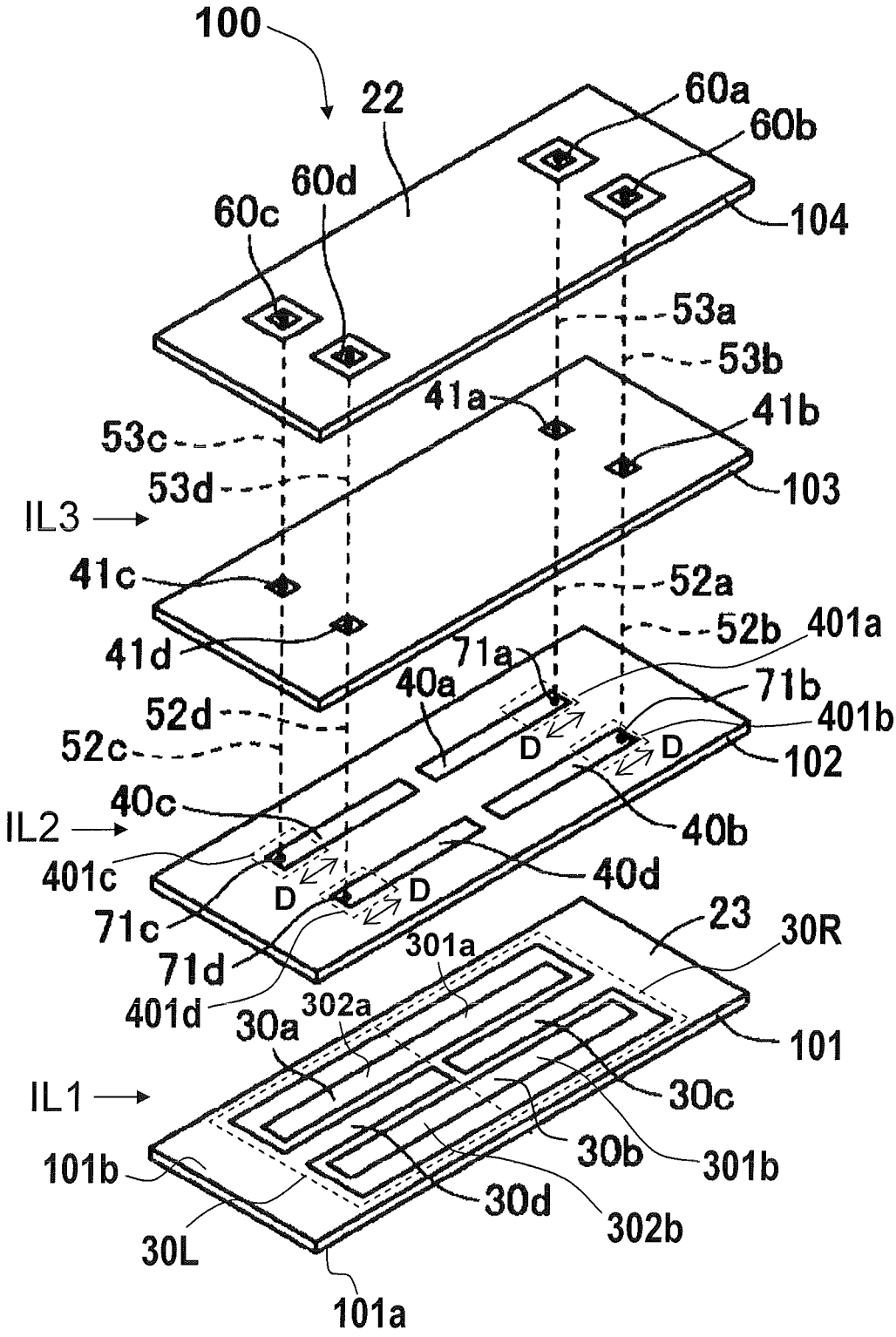
FIG. 2 is an exploded perspective view schematically illustrating the bandpass filter shown in FIG. 1.
Figure 3A:
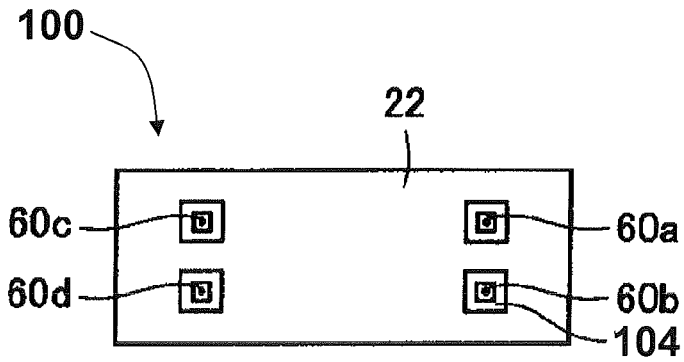
FIG. 3A is a plan view schematically illustrating an upper surface of the bandpass filter shown in FIG. 1.
Figure 3B:
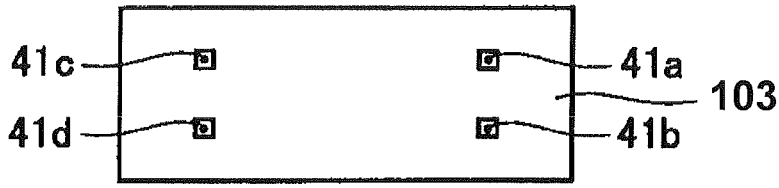
FIG. 3B to 3D are plan views schematically illustrating inter-layers of the bandpass filter shown in FIG. 1.
Figure 3C:
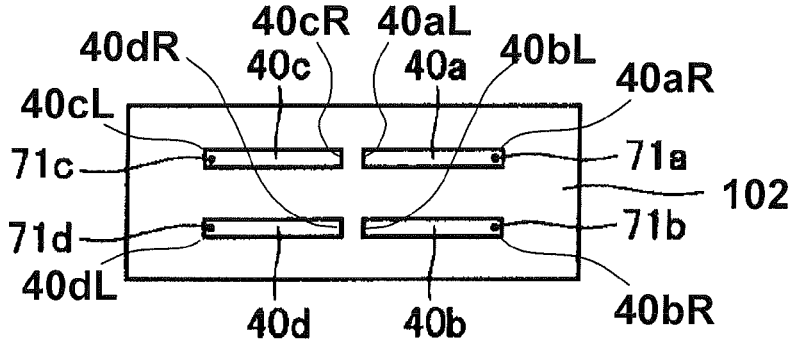
Figure 3D:
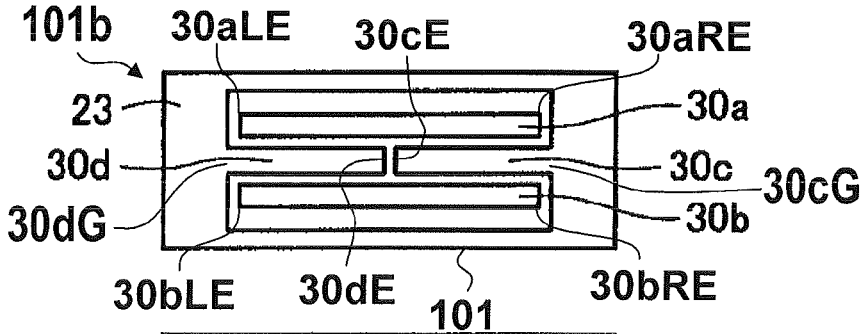
Figure 3E:
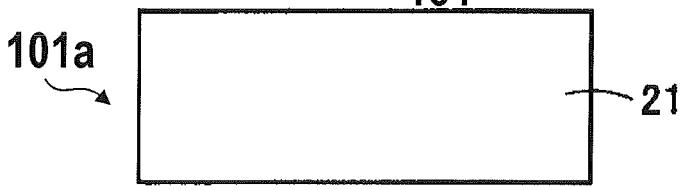
FIG. 3E is a plan view schematically illustrating a bottom lower of the bandpass filter shown in FIG. 1.
Figure 4:
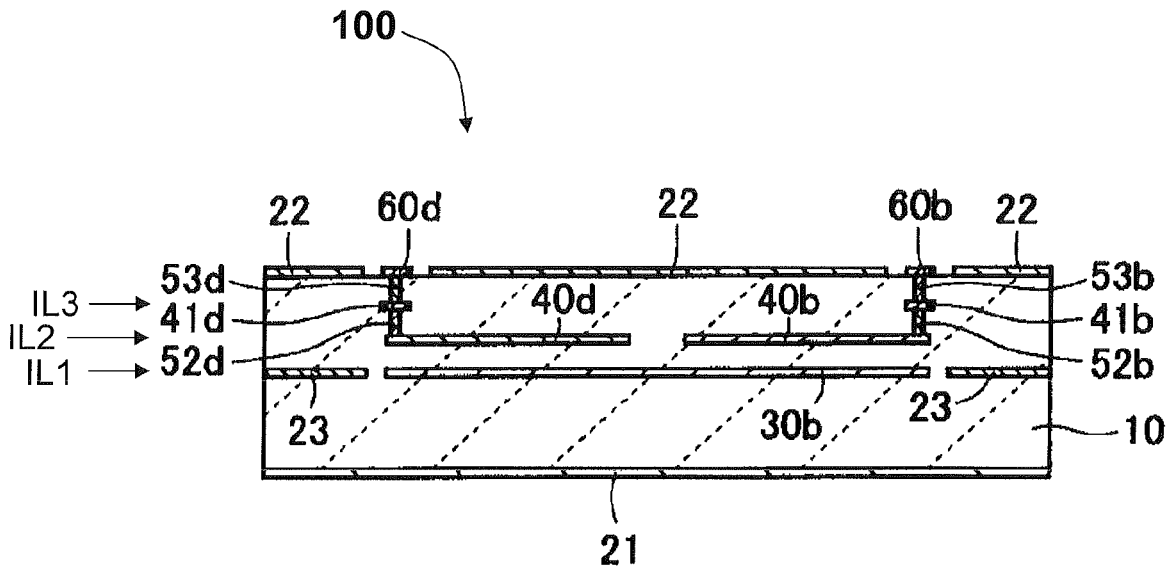
FIG. 4 is a cross sectional view taken along the line IV-IV shown in FIG. 1.

FIG. 1 is a perspective view schematically illustrating the external appearance of a bandpass filter according to one embodiment of the present invention. FIG. 2 is an exploded perspective view schematically illustrating the bandpass filter shown in FIG. 1. FIGS. 3A to 3E are plan views schematically illustrating an upper surface, a lower surface and inter-layers of the bandpass filter shown in FIG. 1. FIG. 4 is a cross sectional view taken along the line IV-IV shown in FIG. 1.

The bandpass filter 100 according to one embodiment of the present invention comprises a laminate 10. The laminate 10 comprises a plurality of dielectric layers 101, 102, 103 and 104 which are stacked. In other words, the laminate 10 comprises a plurality of inter-layers IL1, IL2 and IL3 between two of the dielectric layers 101 to 104. The number of the dielectric layers is not limited for the present invention. Some of dielectric layers may be shown and the other may not be shown in the figures.

The bandpass filter 100 further comprises a first ground electrode 21, a second ground electrode 22. In addition, the bandpass filter 100 may comprise an annular ground electrode 23.

The first ground electrode 21 is located on the bottom surface of the laminate 10. In other words, the first ground electrode 21 is disposed on a lower surface 101*a* of the dielectric layer 101. The first ground electrode 21 can, without limitation, cover the entire surface of the lower surface 101*a*. In an embodiment, one or more additional dielectric layers (not shown) may be arranged under the first ground electrode 21 to sandwich the first ground electrode 21 with the dielectric layer 101.

The second ground electrode 22 is located on the top surface of the laminate 10. In other words, the second ground electrode 22 is disposed on an upper surface of the dielectric layer 104. In an embodiment, one or more additional dielectric layers (not shown) may be attached on the second ground electrode 22 to sandwich the second ground electrode 21 with the dielectric layer 104. The second ground electrode 22 can, without limitation, cover the entire surface of the upper surface of the dielectric layer 104 except a first input terminal electrode 60*a*, a first output stage electrode 60*b*, a second input terminal electrode 60*c*, a second output terminal electrode 60*d* and their peripheries which are located on the dielectric layer 104 and is described in details below.

The bandpass filter 100 further comprises an input resonance electrode 30*a* (first ½ wavelength resonance electrode), an output resonance electrode 30*b* (second ½ wavelength resonance electrode), a first central resonance electrode 30*c* (first ¼ wavelength resonance electrode) and a second central resonance electrode 30*d* (second ¼ wavelength resonance electrode). Hereinafter, a group of the input resonance electrode 30*a*, the output resonance electrode 30*b*, the first central resonance electrode 30*c* and the second central resonance electrode 30*d* may be called as resonance electrodes 30*a*, 30*b*, 30*c* and 30*d*. Each of the resonance electrodes 30*a*, 30*b*, 30*c* and 30*d* may have strip shapes.

The resonance electrodes 30*a*, 30*b*, 30*c* and 30*d* are located on upper surface 101*b* of the dielectric layer 101 of the laminate 10. This surface may be referred to a first inter-layer portion IL1 of the laminate 10.

Both of the first ground electrode 21 and the second ground electrode 22 are connected to the ground potential, and therefore, the first ground electrode 21 and the second ground electrode 22 constitute a strip line resonator along with the resonance electrodes 30*a*, 30*b*, 30*c* and 30*d*.

The bandpass filter 100 further comprises a first input coupling electrode 40*a* (or a first coupling electrode), a first output coupling electrode 40*b* (or a second coupling electrode), a second input coupling electrode 40*c* (or a third coupling electrode) and a second output coupling electrode 40*d* (or a fourth coupling electrode). Hereinafter, a group of the first input coupling electrode 40*a*, the first output coupling electrode 40*b*, the second input coupling electrode 40*c* and the second output coupling electrode 40*d* may be called as coupling electrodes 40*a*, 40*b*, 40*c* and 40*d*. These coupling electrodes can serve as terminal electrodes connecting to terminal electrodes via penetration conductors. Each of the coupling electrodes 40*a*, 40*b*, 40*c* and 40*d* may have strip shapes.

The coupling electrodes 40*a*, 40*b*, 40*c* and 40*d* are located on the surface of a dielectric layer 102 of the laminate 10. This surface may be referred to a second inter-layer portion IL2 of the laminate 10.

The bandpass filter 100 may comprise a first connecting electrode 41*a*, a second connecting electrode 41*b*, a third connecting electrode 41*c* and a fourth connecting electrode 41*d*. Hereinafter, a group of the first connecting electrode 41*a*, the second connecting electrode 41*b*, the third connecting electrode 41*c* and the fourth connecting electrode 40*d* may be called as connecting electrodes 41*a*, 41*b*, 41*c* and 41*d*.

The connecting electrodes 41*a*, 41*b*, 41*c* and 41*d* are located on the surface of a dielectric layer 103 of the laminate 10. This surface may be referred to a third inter-layer portion IL3 of the laminate.

The first connecting electrode 41*a* is connected to the first input coupling electrode 40*a* by a fifth penetration conductor 52*a* which penetrates the dielectric layer 103. The second connecting electrode 41*b* is connected to the first output coupling electrode 40*b* by a sixth penetration conductor 52*a* which penetrates the dielectric layer 103. The third connecting electrode 41*c* is connected to the second input coupling electrode 40*c* by a seventh penetration conductor 52*c* which penetrates the dielectric layer 103. The fourth connecting electrode 41*d* is connected to the second output coupling electrode 40*d* by a eighth penetration conductor 52*d* which penetrates the dielectric layer 103.

The bandpass filter 100 may comprise a first input terminal electrode 60*a*, a first output terminal electrode 60*b*, a second input terminal 60*c*, and a second output terminal electrode 60*d*. Hereinafter, a group of the first input terminal electrode 60*a*, the first output terminal electrode 60*b*, the second input terminal 60*c* and the second output terminal electrode 60*d* may be called as terminal electrodes 60*a*, 60*b*, 60*c* and 60*d*.

The terminal electrodes 60*a*, 60*b*, 60*c* and 60*d* are located on the top surface of the laminate 10. In other words, the terminal electrodes are located on the upper surface of a dielectric layer 104.

The terminal electrodes 60*a*, 60*b*, 60*c* and 60*d* face the connecting electrodes 41*a*, 41*b*, 41*c* and 41*d*, respectively. The first input terminal electrode 60*a* is connected to the first connecting electrode 41*a* by a first penetration conductor 53*a* which penetrates the dielectric layer 104. The second input terminal electrode 60*c* is connected to the third connecting electrode 41*c* by a third penetration conductor 53*c* which penetrates the dielectric layer 104. The first output terminal electrode 60*b* is connected to the second connecting electrode 41*b* by a second penetration conductor 53*b* which penetrates the dielectric layer 104. The second output terminal electrode 60*d* is connected to the fourth connecting electrode 41*d* by a fourth penetration conductor 53*d* which penetrates the dielectric layer 104.

Each of the input resonance electrode 30*a* and the output resonance electrodes 30*b* can serve as a ½ wavelength resonator. Each of the input and output resonance electrodes 30*a* and 30*b* is equivalent to two resonance electrodes, each of which serves as a ¼ wavelength resonator, arranged in one direction.

The input resonance electrode 30*a* comprises two open ends, a right end 30*a*RE and a left end 30*a*LE. The output resonance electrode 30*b* comprises two open ends, a right end 30*b*RE and a left end 30*b*LE. The first central resonance electrode 30*c* comprises two ends, an open end 30*c*E and a first grand end 30*c*G. The first grand end 30*c*G is connected to the annular ground electrode 23. In the same manner, the second central resonance electrode 30*d* comprises two ends, an open end 30*d*E and a second grand end 30*d*G. The second grand 30*d*G is connected to the annular ground electrode 23. The second open end 30*d*E faces the first open end 30*c*E of the first central resonance electrode 30*c* on their sides. That is, one end (ground end 30*c*G or 30*d*G) of each of the central resonance electrodes 30*d* and 30*d* is connected to the annular ground electrode 23, i.e., to the ground potential.

The length of each of the resonance electrodes 30*a*, 30*b*, 30*c* and 30*d* may be, without limitation, about 2 to 6 mm if the relative dielectric constant of the dielectric layers 101, 102, 103 and 104 is set on the order of 10 by setting the center frequency as 4 GHz.

Thus, the right half portion 301*a* of the input resonance electrode 30*a* corresponding to ¼ wavelength and the right half portion 301*b* of the output resonance electrode 30*b* corresponding to ¼ wave length are operable to be coupled electromagnetically (edge coupled) with the first central resonance electrode 30*c* which is located between the input resonance electrode 30*a* and the output resonance electrode 30*b*.

In the same manner, the left half portion 302*a* of the resonance electrode 30*a* corresponding to ¼ wave length and the left half portion 302*b* of the output resonance electrode 30*b* corresponding to ¼ wavelength are operable to be coupled electromagnetically (edge coupling) with the second central resonance electrode 30*d* which is located between the input resonance electrode 30*a* and the output resonance electrode 30*b*.

Accordingly, the right half portion 301*a* of the first resonance electrode 30*a*, the right half portion 301*b* of the output resonance electrode 30*b* and the first central resonance electrode 30*c* are operable to be coupled to each other in an inter-digital type. In the same manner, the left half portion 302*a* of the resonance electrode 30*a*, the left half portion 302*b* of the output resonance electrode 30*b* and the second central resonance electrode 30*d* are coupled to each other in an inter-digital type. Such a coupling is storing because a coupling by magnetic fields is added to a coupling by electric fields.

As the interval between the central resonance electrodes 30*c*, 30*d* and the input resonance electrodes 30*a* becomes narrower, or the interval between the central resonance electrodes 30*c*, 30*d* and the output resonance electrodes 30*b* becomes narrower, the coupling may be stronger. However, if the interval becomes too narrow, the difficulty in manufacturing the resonance electrodes 30*a*, 30*b*, 30*c* and 30*d* may increase. Accordingly, the interval between the resonance electrodes 30*a*, 30*b*, and 30*c* is set, without limitation, about 0.05 to 0.5 mm.

As such, since the resonance electrodes 30*a*, 30*b*, 30*c* and 30*d* are not only edge-coupled but also coupled to each other in the inter-digital type, the frequency interval between resonance frequencies in each resonance mode is adapted to be appropriate to gain a broad pass band width on the order of 40% by the relative bandwidth which is well in excess of the region that can be realized by the conventional filter using the ¼ wavelength resonator and is appropriate as a bandpass filter for UWB.

In addition, our review showed that it is not preferable to make a coupling between the resonance electrodes 30*a*, 30*b*, 30*c* and 30*d* in an inter-digital type and make a broad-side coupling therebetween as well because the coupling becomes too strong to achieve the pass band width of about 40% by the relative bandwidth.

The input coupling electrodes 40*a*, 40*c* which are located on the upper surface of the dielectric layer 102, face the input resonance electrode 30*a* of the input stage on the dielectric layer 101, and therefore are operable to be coupled to the input resonance electrode 30*a*.

In other words, the input coupling electrode 40*a* faces the right half portion 301*a* of the first resonance electrode 30*a* in the right half portion 30R of the resonance electrode region, and therefore, is operable to be electromagnetically coupled to the right half portion 301*a* of the first resonance electrode 30*a*. In the same manner, the output coupling electrode 40*c* faces the left half portion 302*a* of the first resonance electrode 30*a* in the left half portion 30L of the resonance electrode region, and therefore, is operable to be electromagnetically coupled to the left half portion 302*b* of the first resonance electrode 30*a*.

Accordingly, the input coupling electrode 40*a* and the right half portion 301*a* of the first resonance electrode 30*a* in the right half portion 30R of the resonance electrode region of the input stage are broad-side coupled to each other, and therefore, the coupling becomes stronger than the edge-coupling. Also, the input coupling electrode 40*c* and the left half portion 302*a* of the first resonance electrode 30*a* in the left half portion 30L of the resonance electrode region of the input stage are broad-side coupled to each other, and therefore, the coupling becomes stronger than the edge-coupling.

Further, the first input coupling electrode 40*a* is connected to the first input terminal electrode 60*a* on the dielectric layer 104 by penetration conductors 52*a*, 53*a* via the first connecting electrode 41*a*, while the second input coupling electrode 40*c* is connected to the second input terminal electrode 60*c* on the dielectric layer 104 by penetration conductors 52*c*, 53*c* via the third connecting electrode 41*c*.

The first input coupling electrode 40*a* comprises a first contact point 71*a* which is connected to the second penetration conductor 52*a*. The first contact point 71*a* may be located at a region 401*a* which has the length D of less than ¼ of the length of the input resonance electrode 30*a* from the right end 40*a*R of the first input coupling electrode 40*a*. The first contact point 71*a* faces a point near the right end 30*a*RE of the input resonance electrode 30*a*.

The second input coupling electrode 40*c* comprises a third contact point 71*c* which is connected to the second penetration conductor 52*c*. The third contact point 71*c* may be located at a region 401*c* which has the length D of less than ¼ of the length of the input resonance electrode 30*a* from the left end 40*a*L of the second input coupling electrode 40*c*. The third contact point 71*c* faces the left end 30*a*LE of the input resonance electrode 30*a*.

The first input coupling electrode 40*a* comprises an end 40*a*L which is the open end located at the other side of the first contact point 71*a*. The second input coupling electrode 40*c* comprises an end 40*c*R which is the open end located at the other side of the third contact point 71*c*. The ends 40*a*L, 403E are separated and face each other.

A balanced type electrical signal (or a pair of electrical signals comprising a first waveform signal and a second waveform signal which are opposite phase with each other) inputted from an external circuit is supplied not only to the first input coupling electrode 40*a* through the first contact point 71*a* but also to the second input coupling electrode 40*c* through the third contact point 71*c*. Therefore, the input coupling electrodes 40*a*, 40*c* and the resonance electrode 30*a*, 30*c* of the input stage are operable to be coupled to each other in an inter-digital type, respectively, and therefore, a coupling by magnetic fields are added to a coupling by electric fields, so that the coupling becomes stronger than the comb-line type coupling alone or capacitive coupling alone.

As such, since the first input coupling electrode 40*a* can be not only broad-side coupled but also coupled in an inter-digital type with the right half portion 301*a* of the input resonance electrode 30*a* of the input stage, the input coupling electrode 40*a* ends up to be coupled to the right half portion 301*a* of the input resonance electrode 30*a* of the input stage strongly. In the same manner, the second input coupling electrode 40C can be coupled to the left half portion 302*a* of the input resonance electrode 30*a* of the input state strongly.

Similarly, the output coupling electrodes 40*b*, 40*d* are located on the upper surface of the dielectric layer 102 while the input and output resonance electrodes 30*a*, 30*b* is located on the upper surface of the dielectric layer 101, face the output resonance electrode 30*b* of the output stage, and can be coupled to the output resonance electrode 30*b*.

In other words, the output coupling electrode 40*b* faces the right half portion 301*b* of the output resonance electrode 30*b* in right half portion 30R of the resonance electrode region, and therefore, is operable to be electromagnetically coupled to the right half portion 301*b* of the second resonance electrodes 30*b*. In the same manner, the output coupling electrode 40*d* faces the left half portion 302*b* of the output resonance electrode 30*b* in the left half portion 30L of the resonance electrode region, and therefore, can be electromagnetically coupled to the left half portion 302*b* of the output resonance electrodes 30*b*.

Accordingly, the first output coupling electrode 40*b* and the right half portion 301*b* of the output resonance electrode 30*b* in the right half portion 30R of the resonance electrode region of the input stage are broad-side coupled to each other, and therefore, the coupling becomes stronger than the edge-coupling. Also, the second output coupling electrode 40*c* and the left half portion 302*b* of the output resonance electrode 30*b* in the left half portion 30L of the resonance electrode region of the output stage are broad-side coupled to each other, and therefore, the coupling becomes stronger than the edge-coupling.

Further, the first output coupling electrode 40*b* is connected to the first output terminal electrode 60*b* on the dielectric layer 104 by the penetration conductors 52*b*, 53*b* via the second connecting electrode 41*b*, while the second output coupling electrode 40*d* is connected to the second output terminal electrode 60*d* on the dielectric layer 104 by penetration conductors 52*d*, 53*d* via the fourth connecting electrode 41*d*.

The first output coupling electrode 40*b* comprises a second contact point 71*c* which is connected to the second penetration conductor 52*b*. The second contact point 71*b* may be located at a region 401*b* which has the length D of less than ¼ of the length of the output resonance electrode 30*b* from the right end of the first output coupling electrode 40*b*. The second contact point 71*b* faces the right end of the output resonance electrode 30*b*.

The second output coupling electrode 40*d* comprises a second contact point 71*c* which is connected to the fourth penetration conductor 52*d*. The second contact point 71*d* may be located at a region 401*d* which has the length D of less than ¼ of the length of the output resonance electrode 30*b* from the left end of the second output coupling electrode 40*d*. The fourth contact point 71*d* faces the left end of the output resonance electrode 30*b*.

The first output coupling electrode 40*b* comprises an end 40*b*R which is the open end located at the other side of the second contact point 71*b*. The second output coupling electrode 40*d* comprises an end 40*d*R which is the open end located at the other side of the fourth contact point 71*d*. The ends 40*b*R, 40*b*L are separated and face each other.

An electrical signal outputting to an external circuit is drawn not only from a second contact point 71*b* but also from the fourth contact point 71*d*.

Therefore, the output coupling electrode 40*b* and the resonance electrode 30*b* of the output stage are operable to be coupled to each other in the inter-digital type, respectively, and therefore, a coupling by magnetic fields are added to a coupling by electric fields, so that the coupling becomes stronger than the comb line-type coupling alone or capacitive coupling alone.

As such, since the output coupling electrode 40*b* is not only broad-side coupled but also coupled in an inter-digital type with the resonance electrode 30*b* of the output stage, the output coupling electrode 40*b* ends up to be coupled to the resonance electrode 30*b* of the output stage strongly. In the same manner, the second output coupling electrode 40*d* can be coupled to the resonance electrode 30*b* of the output stage strongly.

Since the input coupling electrodes 40*a*, 40*c* and the first resonance electrode 30*a* of the input stage are operable to be coupled to each other strongly and the output coupling electrodes 40*b*, 40*d* and the second resonance electrode 30*b* of the output stage are operable to be coupled to each other strongly, a bandpass filter may be obtained, whose insertion loss is not greatly increased at frequencies located between resonance frequencies in each resonance mode even in the broad pass band width well in excess of the region that may be achieved by the conventional filter using the ¼ wavelength resonator, and which has a flat and low-loss transmission characteristic over the entire region of the broad pass band.

In one embodiment, the shape dimensions of the input coupling electrodes 40*a*, 40*c* may be set to be substantially the half portion of the first resonance electrode 30*a*. In other words, if the input coupling electrodes 40*a*, 40*c* are arranged next each other in the same direction, the total shape dimension of the input coupling electrodes 40*a*, 40*c* is substantially identical to the first resonance electrode 30*a*. Similarly, if the output coupling electrodes 40*b*, 40*d* are arranged next each other in the same direction, the total shape dimension of the input coupling electrodes 40*b*, 40*d* is substantially identical to the second resonance electrode 30*b*.

As the interval between the input coupling electrodes 40*a*, 40*c* and the first resonance electrode 30*a* of the input stage, and the interval between the output coupling electrodes 40*b*, 40*d* and the second resonance electrode 30*b* of the output stage are smaller, the coupling may become stronger but they may become difficult to be manufactured. Therefore, the intervals are set, without limitation, to about 0.01 to 0.5 mm.

The annular ground electrode 23 having a ring shape is located on the upper surface 101*b* of the dielectric layer 101 of the laminate 10. The annular ground electrode 23 surrounds resonance electrodes which comprises the input resonance electrodes 30*a*, the output resonance electrode 30*b*, the first central resonance electrode 30*c* and the second central resonance electrode 30*d*. The annular ground electrode 23 is connected to one end (ground end) of each of the central resonance electrodes 30*c* and 30*c*.

Since the annular ground electrode 23 is connected to the ground potential, the first central resonance electrode 30*c* and the second central resonance electrode 30*d* which are connected to the annular ground electrode 23 can be connected to the ground potential.

In addition, the annular ground electrode 23 reduces the electromagnetic wave generated by the resonance electrodes 30*a*, 30*b*, 30*c* and 30*d* to spread out from the filter. This may be effective to reduce the negative effect on other electrical units in a module which comprises a bandpass filter therein.

In one embodiment, the input terminal electrodes 60*a*, 60*c* and output terminal electrodes 60*b*, 60*d* may be omitted if, for example and without limitation, a bandpass filter is formed inside of a module substrate.

Figure 5:
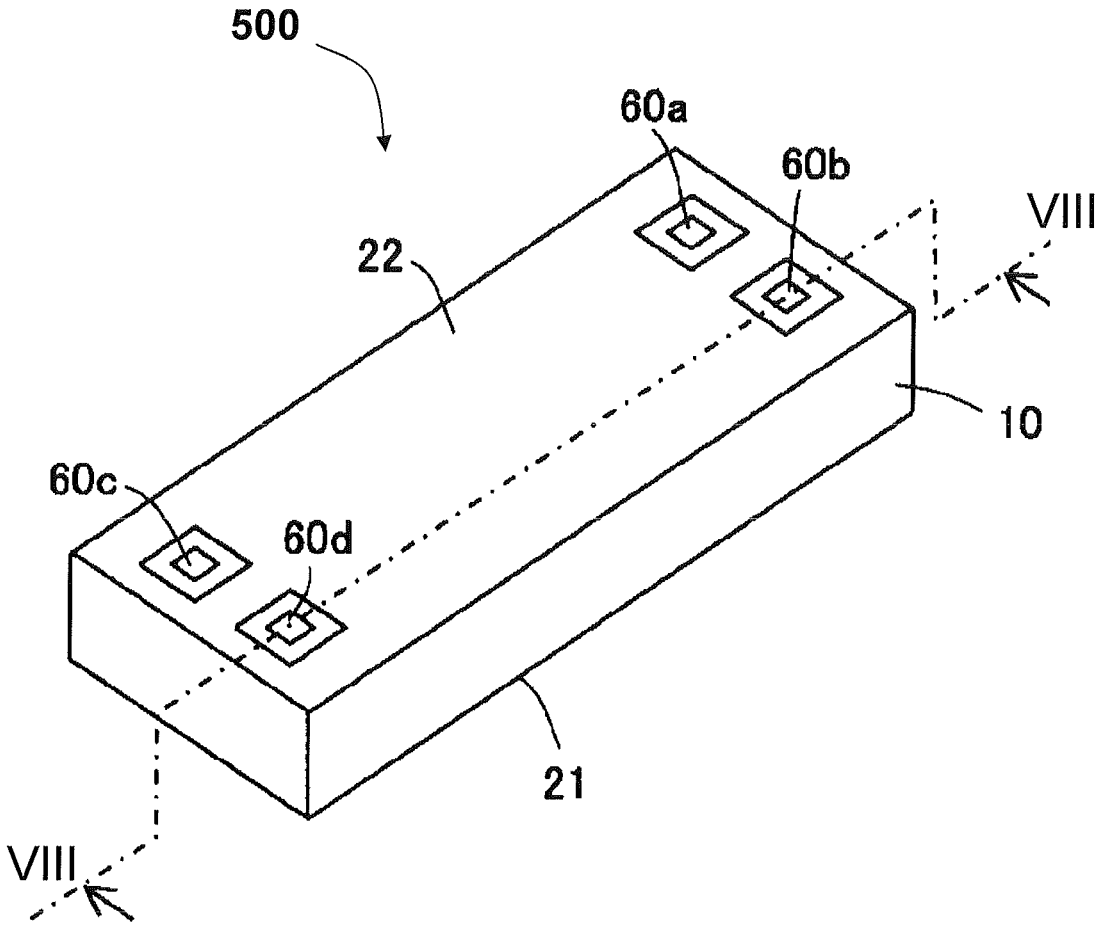
FIG. 5 is a perspective view schematically illustrating the external appearance of a bandpass filter according to one embodiment of the present invention.
Figure 6:
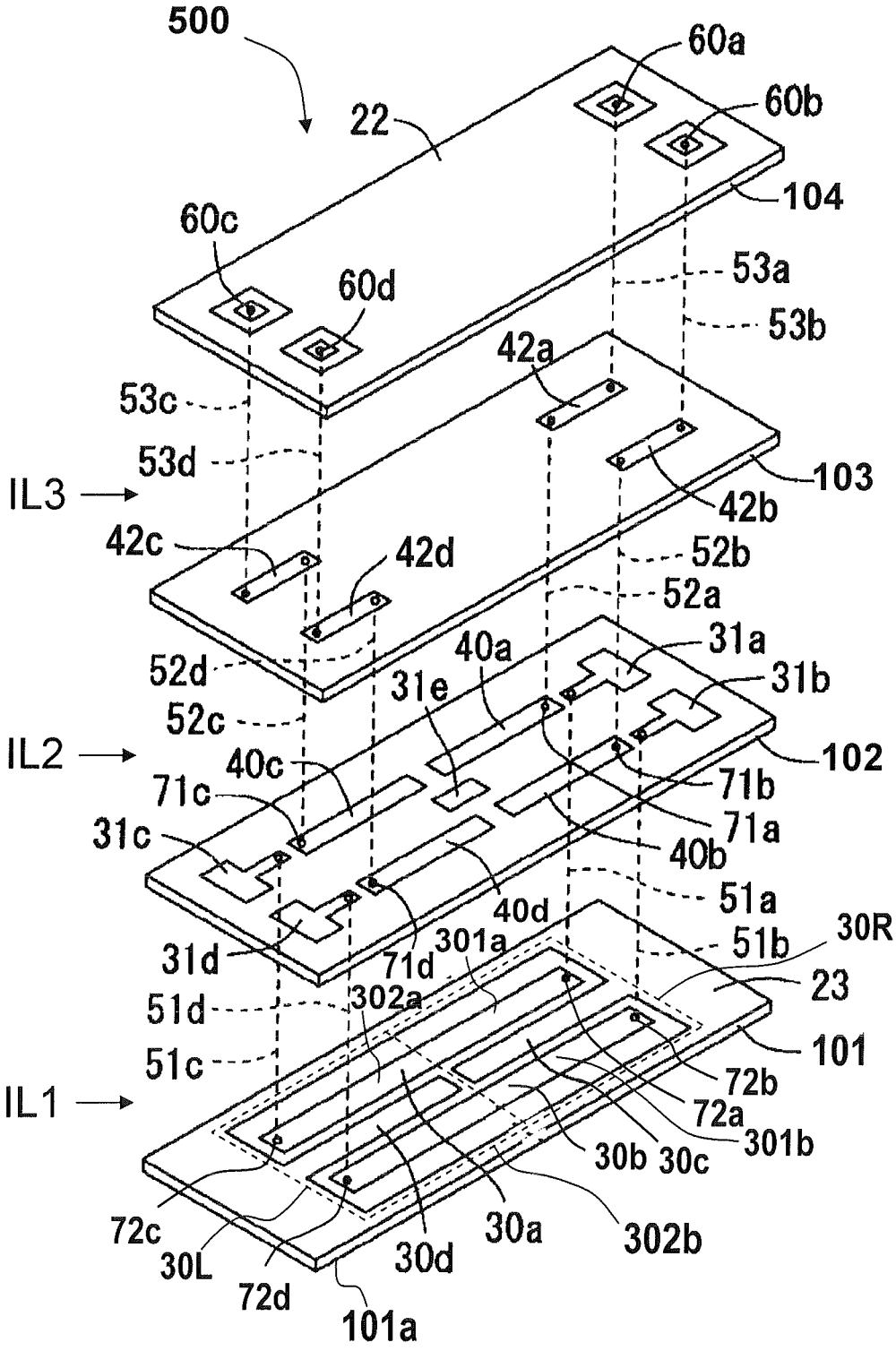
FIG. 6 is an exploded perspective view schematically illustrating the bandpass filter shown in FIG. 5.
Figure 7A:
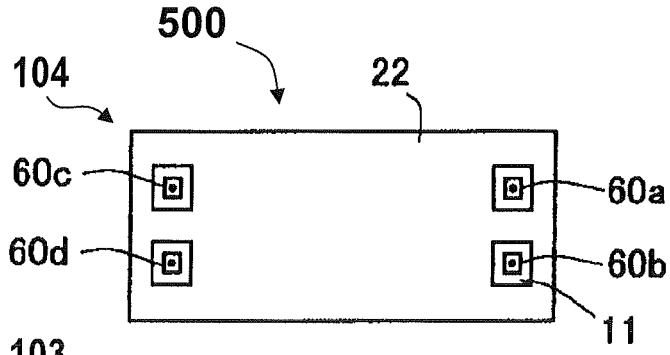
FIG. 7A is a plan view schematically illustrating an upper surface of the bandpass filter shown in FIG. 5.
Figure 7B:
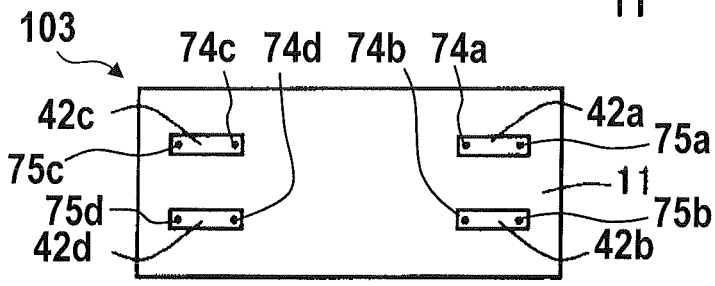
FIG. 7B to 7D are plan views schematically illustrating inter-layers of the bandpass filter shown in FIG. 5.
Figure 7C:
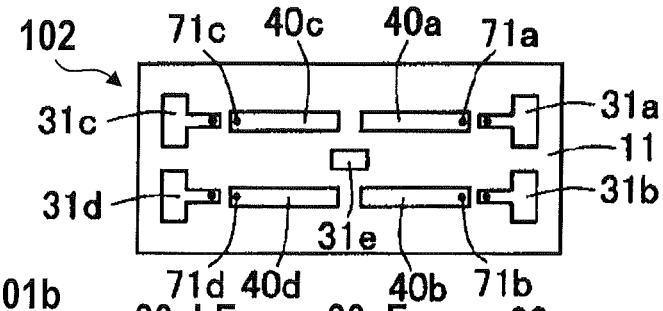
Figure 7D:
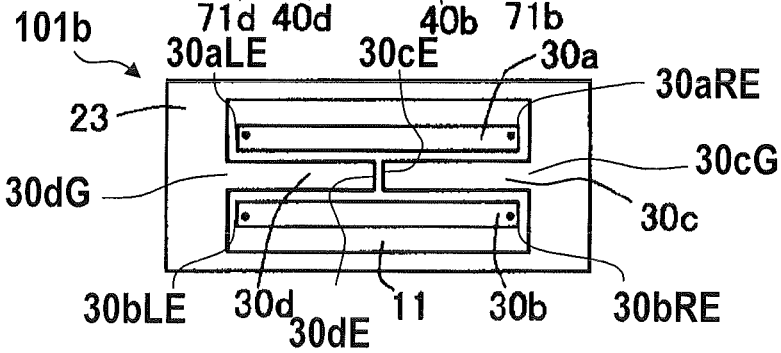
Figure 7E:
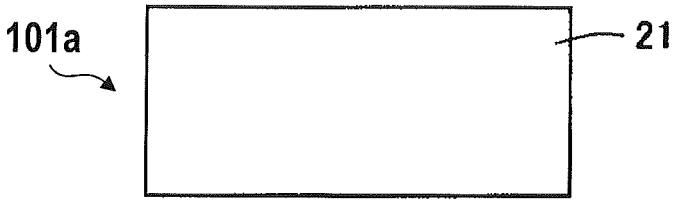
FIG. 7E is a plan view schematically illustrating a bottom lower of the bandpass filter shown in FIG. 5.
Figure 7F:
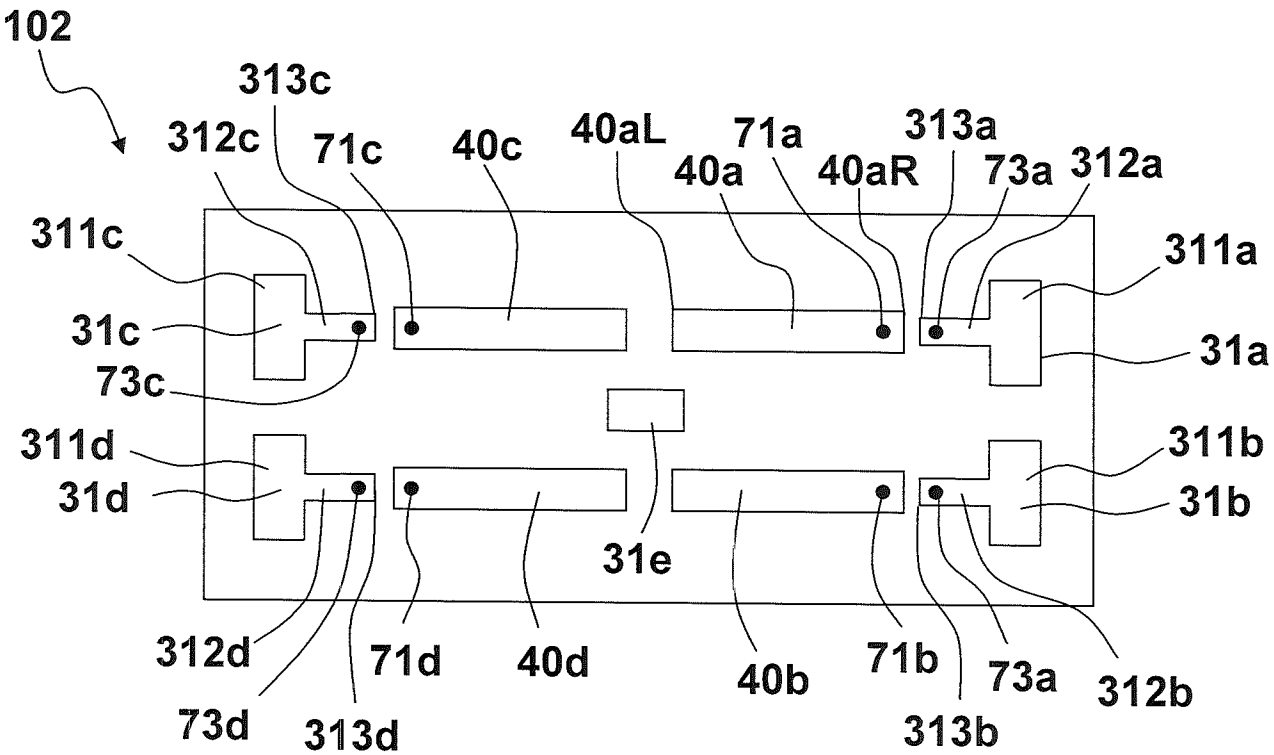
FIG. 7F is an enlarged plan view of FIG. 7C.
Figure 8:
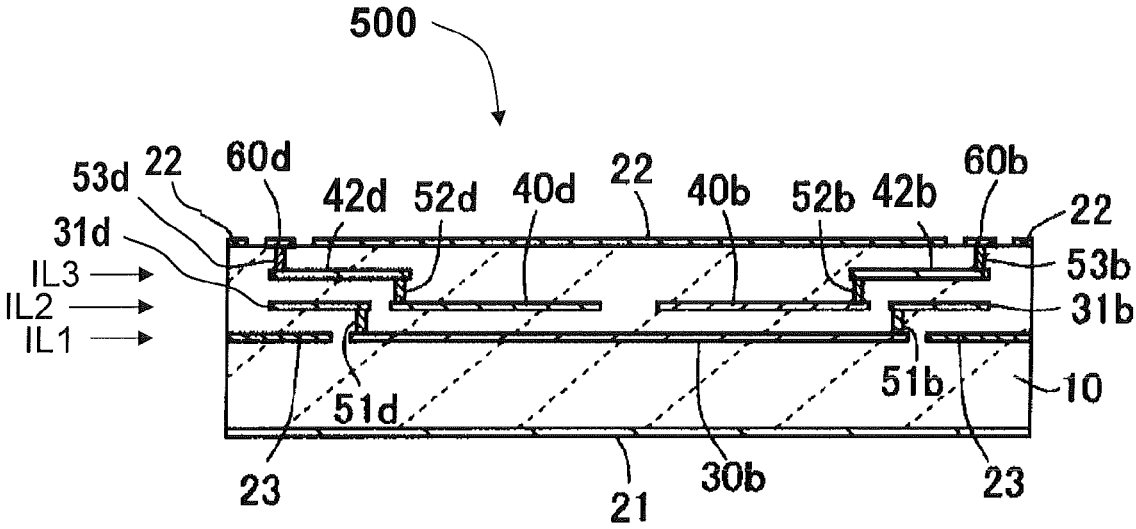
FIG. 8 is a cross sectional view taken along the line VIII-VIII shown in FIG. 5.

FIG. 5 is a perspective view schematically illustrating the external appearance of a bandpass filter according to an embodiment of the present invention. FIG. 6 is an exploded perspective view schematically illustrating the bandpass filter shown in FIG. 5. FIG. 7A is a plan view schematically illustrating an upper surface of the bandpass filter shown in FIG. 5. FIG. 7B to 7D are plan views schematically illustrating inter-layers of the bandpass filter shown in FIG. 5. FIG. 7E is a plan view schematically illustrating a bottom lower of the bandpass filter shown in FIG. 5. FIG. 7F is an enlarged plan view of FIG. 7C. FIG. 8 is a cross sectional view taken along the line VIII-VIII shown in FIG. 5.

The following descriptions focus on only the differences from the embodiments shown in FIGS. 1 to 4, wherein the same reference numerals refer to the same constitutional elements, and therefore, the repetitive descriptions will be omitted.

In one embodiment, a bandpass filter 500 may comprise auxiliary resonance electrodes and/or auxiliary coupling electrodes. As shown in FIGS. 5 to 8, for example, the bandpass filter may comprise a first auxiliary input resonance electrode 31*a*, a second auxiliary input resonance electrode 31*c*, a first auxiliary output resonance electrode 31*b* and a second auxiliary output resonance electrode 31*d* on the dielectric layer 102 where the input coupling electrodes 40*a*, 40*c* and the output coupling electrodes 40*b*, 40*d* are located. In an embodiment, the auxiliary resonance electrodes 31*a*, 31*c*, 31*b*, and 31*d* can be arranged on the different dielectric layer from the dielectric layer on which the coupling electrodes 40*a*, 40*b*, 40*c* and 40*d* are located.

Hereinafter, a group or the first auxiliary input resonance electrode 31*a*, the second auxiliary input resonance electrode 31*c*, the first auxiliary output resonance electrode 31*b* and the second auxiliary output resonance electrode 31*d* may be called as an auxiliary resonance electrodes 31*a*, 31*b*, 31*c* and 31*d*.

The input resonance electrode 30*a* comprises a first input contact point 72*a* near the right end 30*a*RE thereof and a second input point 72*c* near the left end 30*a*LE thereof, and the output resonance electrode 30*b* comprises a first output contact point 72*b* near the right end 30*b*RE thereof and a second output point 72*d* near the right end 30*b*LE thereof.

A first auxiliary input resonance electrode 31*a* comprises a third input contact point 73*a* which is connected to the first input contact point 72*a* of the input resonance electrode 30*a* via a penetration conductor 51*a* which penetrates the dielectric layer 104. A second auxiliary input resonance electrode 31*c* comprises a fourth input contact point 73*c* which is connected to the second input contact point 72*c* of the input resonance electrode 30*a* via a penetration conductor 51*c* which penetrates the dielectric layer 104.

A first auxiliary output resonance electrode 31*b* comprises a third output contact point 73*b* which is connected to the first output contact point 72*b* of the output resonance electrode 30*b* via a penetration conductor 51*b* which penetrates the dielectric layer 104. A second auxiliary output resonance electrode 31*d* comprises a fourth output contact point 73*d* which is connected to the second output contact point 72*d* of the output resonance electrode 30*d* via a penetration conductor 51*d* which penetrates the dielectric layer 104.

The auxiliary resonance electrodes 31*a*, 31*b*, 31*c* and 31*d* may have a desired shape such as a triangle, a square, and the like. The auxiliary resonance electrodes 31*a*, 31*b*, 31*c* and 31*d* can have, for example, "T" shapes as shown in FIGS. 6, 7C and 7F. As shown in FIGS. 6, 7C and 7F, the first auxiliary input resonance electrode 31*a* comprises a first portion 311*a* which faces a part of the annular ground electrode 23, and a second portion 312*a* which comprises an open end 313*a*. The second portion 312*a* faces the first input coupling electrode 40*a* at the side of the first end 313*a*. The second portion 312*a* comprises the third input contact point 73*a* near the open end 313*a*.

In the same manner, the second auxiliary input resonance electrode 31*c* comprises a third portion 311*c* which faces a part of the annular ground electrode 23, and a fourth portion 312*c* which comprises an open end 313*c*. The fourth portion 312*c* faces the second input coupling electrode 40*c* at the side of the open end 313*c*. The third portion 312*c* comprises the fourth input contact point 73*c* near the open end 313*c*.

A first auxiliary output resonance electrode 31*b* comprises a fifth portion 311*b* which faces a part of the annular ground electrode 23, and a sixth portion 312*b* which comprises an second end 313*b*. The sixth portion 312*b* faces the first output coupling electrode 40*b* at the side of the third end 313*b*. The sixth portion 312*b* comprises the third output contact point 73*b* near the open end 313*b*.

The second auxiliary output resonance electrode 31*c* comprises a seventh portion 311*d* which faces a part of the annular ground electrode 23, and a eighth portion 312*d* which comprises an fourth end 313*d*. The eighth portion 312*d* faces the second output coupling electrode 40*d* at the side of the fourth end 313*b*. The eighth portion 312*c* comprises the fourth output contact point 73*d* near the open end 313*d*.

A bandpass filter 500 may comprise a third ground electrode 31*e* on the dielectric layer 102. A part of the annular ground electrode 23 may face the first auxiliary output resonance electrode 31*b* at near the open end 30*c*E and the second auxiliary output resonance electrode 31*d* at near the open end 30*d*E. That is, the third ground electrode 31*e* is configured to be located such that the third ground electrode 31*e* faces each end of the first central resonance electrode 30*c* and the second central resonance electrode 30*d*, and therefore, the third ground electrode 31*e* is operable to be electromagnetically coupled to the first central resonance electrode 30*c* and the second central resonance electrode 30*d* equally. In such a case, the third ground electrode 31*e* may be located at a null point, and therefore have a ground potential.

Therefore, the third ground electrode 31*e* is not necessary to physically connect to a ground electrode as long as the third ground electrode 31*e* faces each end of the first central resonance electrode 30*c* and the second central resonance electrode 30*d*. This configuration is as effective as the configuration where the first auxiliary input resonance electrode 31*a*, the second auxiliary input resonance electrode 31*c*, the first auxiliary output resonance electrode 31*b*, and the second auxiliary output resonance electrode 31*d* face the annular ground electrode 23. According to the configuration comprising the third ground electrode 31*e*, the length of the resonance electrodes 30*a*, 30*b*, 30*c* and 30*d* can be shortened.

Each of the auxiliary resonance electrodes 31*a*, 31*b*, and 31*c* faces a facing area of the annular ground electrode 23. In the facing areas, capacitance is generated between the auxiliary resonance electrodes 31*a*, 31*b*, 31*c* and 31*d* and the annular ground electrode 23, and also between an area, which face the third ground electrode 31*e*, of the first central resonance electrode 30*c* near the one end thereof and an area, which face the third ground electrode 31*e*, of the second central resonance electrode 30*d* near the one end thereof, and the third ground electrode 31*e*. This configuration may shorten the length of the resonance electrodes 30*a*, 30*b*, and 30*c*, thus enabling a small-size bandpass filter.

Considering the dimensions and the capacitance, the facing area may be set, for example, to an area with about 0.01 to 0.3 $mm^2$. As the interval between the facing areas is smaller, a stronger coupling may be achieved, however, this makes it uneasy to manufacture the bandpass filter. Therefore, the interval is set, without limitation and for example, to about 0.05 to 0.5 mm.

The number and the arrangement of auxiliary resonance electrodes and ground electrodes are not limited to ones shown in FIGS. 5 to 8. For example, the bandpass filter 500 comprises two auxiliary resonance electrodes, the first auxiliary input resonance electrode 31*a* and the first auxiliary output resonance electrode 31*b*. That is, the second auxiliary input resonance electrode 31*c* and the second auxiliary output resonance electrode 31*d* can be omitted in an embodiment. Also, the bandpass filter 500 comprises the third ground electrode 31*e* which faces only the open end 30*c*E of the first central resonance electrode 30*c*. In this case, the third ground electrode 31*e* is not at a null point, and therefore the third ground electrode 31*e* is connected to a ground potential.

In an embodiment, a bandpass filter may comprise one or more auxiliary input coupling electrodes, and one or more auxiliary output coupling electrodes. Specifically, referring to FIGS. 5 to 8, the bandpass filter 500 further comprise a first auxiliary input coupling electrode 42*a* (or a first auxiliary coupling electrode), a second auxiliary input coupling electrode 42*c* (or a second auxiliary coupling electrode), a first auxiliary output coupling electrode 42*b* (or a third auxiliary coupling electrode), and a second auxiliary output coupling electrode 42*d* (or a fourth auxiliary coupling electrode) on the dielectric layer 103 which is one layer above the dielectric layer 103.

The first auxiliary input coupling electrode 42*a* comprises a first coupling contact point 74*a* and a first connecting point 75*a*. The first coupling contact point 74*a* is connected to the first input contact point 71*a* via a penetration conductor 52*a*, and the first connecting point 75*a* is connected to the first input terminal 60*a* via a penetration conductor 53*a*. A part of the first auxiliary input coupling electrode 42*a* is configured to face the first auxiliary input resonance electrode 31*a*.

The first auxiliary input coupling electrode 42*a* connected to the first input coupling electrode 40*a* and the first auxiliary input resonance electrodes 31*a* connected to the right half portion 301*a* of the input resonance electrode 30*a* are broad-side coupled. In addition, a part of the first auxiliary input coupling electrode 42*a* faces the first auxiliary input resonance electrode 31*a* and is connected to the first input terminal electrode 60*a* at the first connecting point 75*a* via the penetration conductor 53*a*. That is, a balanced type electrical signal inputted from an outside circuit is provided to the first input coupled electrode 40*a* via the first auxiliary input coupling electrode 42*a*.

Therefore, the coupling (first additional coupling) between the first auxiliary input coupling electrode 42*a* and the first auxiliary input resonance electrodes 31*a* is added to the coupling between the first input coupling electrode 40*a* and the right half portion 301*a* of the input resonance electrodes 30*a*, thereby making the overall coupling an inter-digital coupling. Therefore the overall coupling is strong.

Consequently, the coupling mentioned above can have a stronger coupling than that without the first additional coupling or that in a case in which the first auxiliary input coupling electrode 42*a* is connected to the first input terminal electrode 60*a* at the first coupling contact point 74*a* instead of the first connecting point 75*a*.

The second auxiliary input coupling electrode 42*c* comprises a second coupling contact point 74*c* and a second connecting point 75*c*. The second coupling contact point 74*c* is connected to the second input contact point 71*c* via a penetration conductor 52*c*, and the second connecting point 75*c* is connected to the second input terminal 60*c* via a penetration conductor 53*c*. A part of the second auxiliary input coupling electrode 42*c* is configured to face the second auxiliary input resonance electrode 31*c*.

The second auxiliary input coupling electrode 42*c* connected to the second input coupling electrode 40*c* and the second auxiliary input resonance electrode 31*c* connected to the right half portion 302*a* of the input resonance electrode 30*a* are broad-side coupled. In addition, a part of the second auxiliary input coupling electrode 42*c* faces the second auxiliary input resonance electrode 31*c* and is connected to the first input terminal electrode 60*c* at the second connecting point 75*c* via the penetration conductor 53*c*. That is, a balanced type electrical signal inputted from an outside circuit is provided to the second input coupled electrode 40*c* via the second auxiliary input coupling electrode 42*c*.

Therefore, the coupling (second additional coupling) between the second auxiliary input coupling electrode 42*c* and the first auxiliary input resonance electrodes 31*a* is added to the coupling between the second input coupling electrode 40*c* and the left half portion 302*a* of the input resonance electrodes 30*a*, thereby making the overall coupling an inter-digital coupling. Therefore the overall coupling is strong.

Consequently, the coupling mentioned above can have a stronger coupling than that without the second additional coupling or that in a case in which the second auxiliary input coupling electrode 42*c* is connected to the second input terminal electrode 60*c* the second coupling contact point 74*c* instead of the second connecting point 75*c*.

The first auxiliary output coupling electrode 42*b* comprises a third coupling contact point 74*b* and a third connecting point 75*b*. The third coupling contact point 74*b* is connected to the first output contact point 71*b* via a penetration conductor 52*b*, and the third connecting point 75*a* is connected to the third input terminal 60*b* via a penetration conductor 53*b*. A part of the first auxiliary output coupling electrode 42*b* is configured to face the first auxiliary output resonance electrode 31*c*.

The first auxiliary output coupling electrode 42*b* connected to the first output coupling electrode 40*b* and the first auxiliary output resonance electrodes 31*b* connected to the right half portion 301*b* of the output resonance electrode 30*b* are broad-side coupled. In addition, a part of the first auxiliary output coupling electrode 42*b* faces the first auxiliary output resonance electrode 31*a* and is connected to the first output terminal electrode 60*b* at the third connecting point 75*b* via the penetration conductor 53*b*. That is, a balanced type electrical signal is outputting to an outside circuit from the first output coupled electrode 40*b* via the first auxiliary output coupling electrode 42*b*.

Therefore, the coupling (third additional coupling) between the first auxiliary output coupling electrode 42*b* and the first auxiliary output resonance electrodes 31*b* is added to the coupling between the first output coupling electrode 40*b* and the right half portion 301*b* of the output resonance electrodes 30*b*, thereby making the overall coupling an inter-digital coupling. Therefore the overall coupling is strong.

Consequently, the coupling mentioned above can have a stronger coupling than that without the first additional coupling or that in a case in which the first auxiliary output coupling electrode 42*b* is connected to the first output terminal electrode 60*b* at the third coupling contact point 74*a* instead of the third connecting point 75*a*.

The second auxiliary output coupling electrode 42*d* comprises a fourth coupling contact point 74*d* and a fourth connecting point 75*a*. The fourth coupling contact point 74*d* is connected to the second output contact point 71*d* via a penetration conductor 52*d*, and the fourth connecting point 75*d* is connected to the second output terminal 60*d* via a penetration conductor 53*d*. A part of the second auxiliary output coupling electrode 42*d* is configured to face the first auxiliary output resonance electrode 31*d*.

The second auxiliary output coupling electrode 42*d* connected to the second output coupling electrode 40*d* and the second auxiliary output resonance electrodes 31*d* connected to the left half portion 302*b* of the output resonance electrode 30*b* are broad-side coupled. In addition, a part of the second auxiliary output coupling electrode 42*b* faces the second auxiliary output resonance electrode 31*a* and is connected to the second output terminal electrode 60*d* at the fourth connecting point 75*b* via the penetration conductor 53*d*. That is, a balanced type electrical signal is outputting to an outside circuit from the second output coupled electrode 40*d* via the second auxiliary output coupling electrode 42*b*.

Therefore, the coupling (fourth additional coupling) between the second auxiliary output coupling electrode 42*d* and the second auxiliary output resonance electrodes 31*d* is added to the coupling between the second output coupling electrode 40*d* and the left half portion 302*b* of the output resonance electrodes 30*b*, thereby making the overall coupling an inter-digital coupling. Therefore the overall coupling is strong.

Consequently, the coupling mentioned above can have a stronger coupling than that without the fourth additional coupling or that in a case in which the second auxiliary output coupling electrode 42*d* is connected to the second output terminal electrode 60*d* at the fourth coupling contact point 74*d* instead of the fourth connecting point 75*d*.

The bandpass filter 500 with such a structure can reduce an increase of insertion loss at frequencies between resonance frequencies of resonance mode even in the broad pass band, and has a flat and low-loss transmission characteristic over the entire region of the broad pass band.

In an embodiment, the widths of the auxiliary input coupling electrode 42*a*, 42*c* and auxiliary output coupling electrodes 42*b*, 42*d* may be set, without limitation, to be substantially the same as those of the input coupling electrodes 40*a*, 40*c* and the output coupling electrodes 40*b*, 40*d*, respectively. The lengths of the auxiliary input coupling electrode 42*a*, 42*c* and auxiliary output coupling electrodes 42*b*, 42*d* may be set, without limitation, to be substantially the same as those of the input auxiliary resonance electrodes 31*a*, 31*c* and the output auxiliary resonance electrodes 31*b*, 31*d*, respectively. As the dielectric layer 103 which is equal to the distance between the auxiliary coupling electrodes 42*a*, 42*b*, 42*c*, 42*d* and the auxiliary resonance electrodes 31*a*, 31*b*, 30*c*, 31*d* is thinner, each coupling may become stronger but they may become difficult to be manufactured. Therefore, the thickness of the dielectric layer 103 (i.e. the distance between the auxiliary coupling electrodes and the auxiliary resonance electrodes) is set, without limitation, to about 0.01 to 0.5 mm.

According to an embodiment of the present invention, one or more additional auxiliary resonance electrodes (not shown) may be added to the auxiliary resonance electrodes 31*a*, 31*b*, 30*c* and 31*d* in another dielectric layer. For example, the additional auxiliary resonance electrodes may be located on a dielectric layer (not shown) which is under the dielectric layer 101 on which the resonance electrodes 30*a*, 30*b*, 30*c* and 30*d* are located.

In addition, the additional auxiliary resonance electrodes may be electrically connected to the first central resonance electrode 30*c* or the second central resonance electrode 30*d* via penetration conductors. This configuration can make the capacitance bigger if the size of the resonance electrodes 30*a*, 30*b*, 30*c* and 30*d* is same, and make the size of the resonance electrodes 30*a*, 30*b*, 30*c* and 30*d* smaller if the capacitance is same.

Furthermore, the bandpass filter 500 may comprise one or more additional couplings added to the couplings between the coupling electrodes 40*a*, 40*b*, 40*c* and 40*d* and the resonance electrodes 30*a* and 30*b*, and between the auxiliary input coupling electrodes 42*a*, 42*b*, 42*c* and 42*d* and the auxiliary input resonance electrode 31*a*, 31*b*, 31*c* and 31*d*. The additional electrode for additional couplings may be located in any inter-layer(s).

In the same manner, the bandpass filter 500 may comprise another pair of electrode for output and the additional coupling can be added to the coupling between the first output coupling electrode 40*b* and the output resonance electrode 30*b*, and between the first auxiliary output coupling electrode 42*b* and the first auxiliary output resonance electrode 31*b* (or between the second output coupling electrode 40*d* and the output resonance electrode 30*b*, and between the second auxiliary output coupling electrode 42*d* and the second auxiliary output resonance electrode 31*d*).

Figure 9:
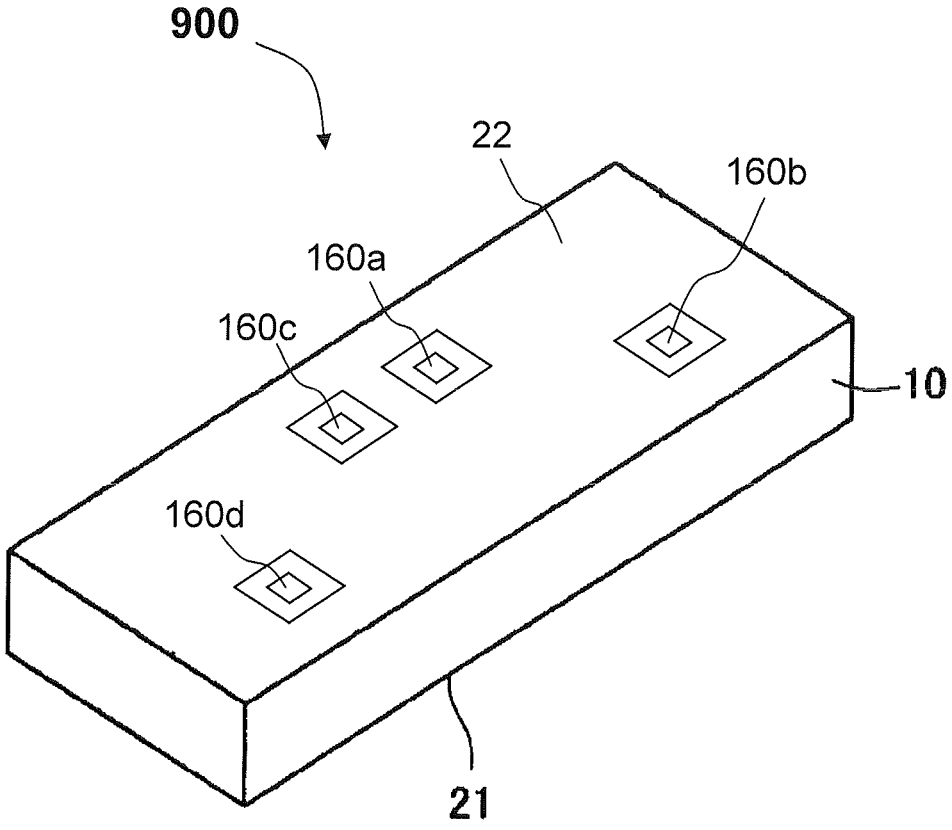
FIG. 9 is a perspective view schematically illustrating the external appearance of a bandpass filter according to one embodiment of the present invention.
Figure 10:
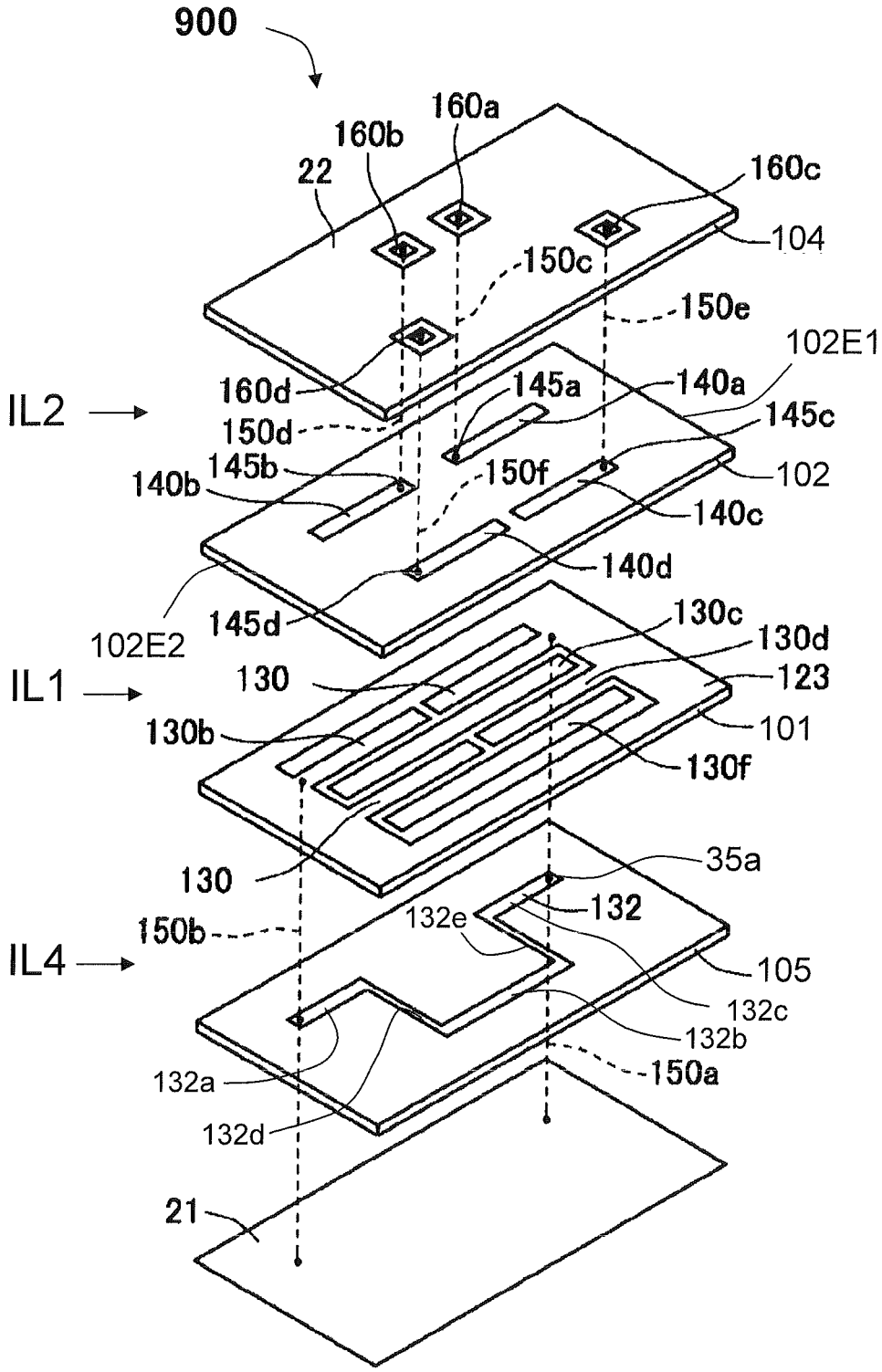
FIG. 10 is an exploded perspective view schematically illustrating the bandpass filter shown in FIG. 9.

FIG. 9 is a perspective view schematically illustrating the external appearance of a bandpass filter 900 according to one embodiment of the present invention. FIG. 10 is an exploded perspective view schematically illustrating the bandpass filter 900 shown in FIG. 9.

The following descriptions focus on only the differences from the embodiments shown in FIGS. 1 to 4, wherein the same reference numerals refer to the same constitutional elements, and therefore, the repetitive descriptions will be omitted.

The following description focuses on only the differences from the embodiments shown in FIGS. 1 to 4, wherein the same reference numerals refer to the same constitutional elements, and therefore, the repetitive descriptions will be omitted.

A bandpass filter 900 shown in FIG. 10 comprises a laminated body 10. The laminate 10 comprises dielectric layers of which dielectric layers 101, 102, 104 and 105 are shown in FIG. 10. The bandpass filter 900 further comprises a first ground electrode 21, a second ground electrode 22. In FIG. 10, the first ground electrode 21 is illustrated as a layer but it is located on the bottom surface of the dielectric layer 105. The second ground electrode 22 is located on an upper surface of the dielectric layer 104.

The bandpass filter 900 further comprises an input/output-stage ½ wavelength resonant electrode 130*f*, a central-stage ½ wavelength resonant electrode 130*c*, a first central-stage ¼ wavelength resonant electrode 130*d*, a second central-stage ¼ wavelength resonant electrode 130*e*, a first input/output-stage ¼ wavelength resonant electrode 130*a*, a second input/output-stage ¼ wavelength resonant electrode 130*b*. The input/output-stage ½ wavelength resonant electrode 130*f*, the central-stage ½ wavelength resonant electrode 130*c*, the first central-stage ¼ wavelength resonant electrode 130*d*, the second central-stage ¼ wavelength resonant electrode 130*e*, the first input/output-stage ¼ wavelength resonant electrode 130*a* and the second input/output-stage ¼ wavelength resonant electrode 130*b* are located on the dielectric layer 101.

The bandpass filter 900 further comprises a first coupling electrode 140*a*, a second coupling electrode 140*b*, a third coupling electrode 140*c*, a fourth coupling electrode 140*d*, and a resonant electrode coupling conductor 132. The first coupling electrode 140*a*, the second coupling electrode 140*b*, the third coupling electrode 140*c* and the fourth coupling electrode 140*d* are located on the dielectric layer 102. The resonant electrode coupling conductor 132 is located on the dielectric layer 105.

The input/output-stage ½ wavelength resonant electrode 130*f* and the central-stage ½ wavelength resonant electrode 130*c* are disposed in a first inter-layer IL1 of the laminate in parallel with each other. The first central-stage ¼ wavelength resonant electrode 130*d* is disposed in the first inter-layer IL1 between the input/output-stage ½ wavelength resonant electrode 130*f* and the central-stage ½ wavelength resonant electrode 130*c* such that electromagnetic field coupling is mutually generated between the first central-stage ¼ wavelength resonant electrode 130*d* and the input/output-stage ½ wavelength resonant electrode 130*f* and central-stage ½ wavelength resonant electrode 130*c*. The first central-stage ¼ wavelength resonant electrode 130*d* faces a one-end-side region on one end side from a center in a length direction of the input/output-stage ½ wavelength resonant electrode 130*f*, and the first central-stage ¼ wavelength resonant electrode 130*d* also faces a one-end-side region on one end side from the center in the length direction of the central-stage ½ wavelength resonant electrode 130*c*. In the first central-stage ¼ wavelength resonant electrode 130*d*, an end portion close to one end of each of the input/output-stage ½ wavelength resonant electrode 130*f* and the central-stage ½ wavelength resonant electrode 130*c* forms a ground end, and the opposite end portion forms an open end. The second central-stage ¼ wavelength resonant electrode 130*e* is disposed in the first inter-layer IL1 between the input/output-stage ½ wavelength resonant electrode 130*f* and the central-stage ½ wavelength resonant electrode 130*c* such that the electromagnetic field coupling is mutually generated between the second central-stage ¼ wavelength resonant electrode 130*e* and the input/output-stage ½ wavelength resonant electrode 130*f* and central-stage ½ wavelength resonant electrode 130*c*. The second central-stage ¼ wavelength resonant electrode 130*e* faces the-other-end-side region on the other end side from the center in the length direction of the input/output-stage ½ wavelength resonant electrode 130*f*, and the second central-stage ¼ wavelength resonant electrode 130*e* also faces the-other-end-side region on the other end side from the center in the length direction of the central-stage ½ wavelength resonant electrode 130*c*. In the second central-stage ¼ wavelength resonant electrode 130*e*, an end portion close to the other end of each of the input/output-stage ½ wavelength resonant electrode 130*f* and the central-stage ½ wavelength resonant electrode 130*c* forms the ground end, and the opposite end portion forms the open end.

The first input/output-stage ¼ wavelength resonant electrode 130*a* is disposed such that the electromagnetic field coupling is mutually generated between the first input/output-stage ¼ wavelength resonant electrode 130*a* and the central-stage ½ wavelength resonant electrode 130*c*. The first input/output-stage ¼ wavelength resonant electrode 130*a* is located across the central-stage ½ wavelength resonant electrode 130*c* in the first inter-layer IL1 from the first central-stage ¼ wavelength resonant electrode 130*d*, and the first input/output-stage ¼ wavelength resonant electrode 130*a* faces the one-end-side region of the central-stage ½ wavelength resonant electrode 130*c*. In the first input/output-stage ¼ wavelength resonant electrode 130*a*, an end portion close to one end of the central-stage ½ wavelength resonant electrode 130*c* forms the ground end, and the opposite end portion forms the open end. The second input/output-stage ¼ wavelength resonant electrode 130*b* is disposed such that the electromagnetic field coupling is mutually generated between the second input/output-stage ¼ wavelength resonant electrode 130*b* and the central-stage ½ wavelength resonant electrode 130*c*. The second input/output-stage ¼ wavelength resonant electrode 130*b* is located across the central-stage ½ wavelength resonant electrode 130*c* in the first inter-layer IL1 from the second central-stage ¼ wavelength resonant electrode 130*e*, and the second input/output-stage ¼ wavelength resonant electrode 130*b* faces the-other-end-side region of the central-stage ½ wavelength resonant electrode 130*c*. In second input/output-stage ¼ wavelength resonant electrode 130*b*, an end portion close to the other end of the central-stage ½ wavelength resonant electrode 130*c* forms the ground end, and the opposite end portion forms the open end.

The first coupling electrode 140*a* is disposed in a second inter-layer IL2 such that the electromagnetic field coupling is generated between the first coupling electrode 140*a* and the first input/output-stage ¼ wavelength resonant electrode 130*a*. The second inter-layer IL2 is different from the first inter-layer IL1 of the laminate. The first coupling electrode 140*a* faces the first input/output-stage ¼ wavelength resonant electrode 130*a*. The second coupling electrode 140*b* is disposed in the second inter-layer IL2 such that the electromagnetic field coupling is generated between the second coupling electrode 140*b* and the second input/output-stage ¼ wavelength resonant electrode 130*b*. The second coupling electrode 140*b* faces the second input/output-stage ¼ wavelength resonant electrode 130*b*. The third coupling electrode 140*c* is disposed in the second inter-layer IL2 such that the electromagnetic field coupling is generated between the third coupling electrode 140*c* and the input/output-stage ½ wavelength resonant electrode 130*f*. The third coupling electrode 140*c* faces the one-end-side region of the input/output-stage ½ wavelength resonant electrode 130*f*. The fourth coupling electrode 140*d* is disposed in the second inter-layer IL2 such that the electromagnetic field coupling is generated between the fourth coupling electrode 140*d* and the input/output-stage ½ wavelength resonant electrode 130*f*. The fourth coupling electrode 140*d* faces the-other-end-side region of the input/output-stage ½ wavelength resonant electrode 130*f*.

The resonant electrode coupling conductor 132 is disposed in a third inter-layer IL3 that is located across the first inter-layer IL1 of the laminate from the second inter-layer IL2. The resonant electrode coupling conductor 132 comprises a first portion 132*a*, a second portion 132*b*, a third portion 132*c* and connecting portions 132*d* and 132*e*.

In the resonant electrode coupling conductor 132, one end is grounded near the ground terminal of the first input/output-stage ¼ wavelength resonant electrode 130*a*. The resonant electrode coupling conductor 132 has a region that faces the ground end side of the first input/output-stage ¼ wavelength resonant electrode 130*a* such that the electromagnetic field coupling is generated between the resonant electrode coupling conductor 132 and the first input/output-stage ¼ wavelength resonant electrode 130*a*. In the resonant electrode coupling conductor 132, the other end is grounded near the ground terminal of the second input/output-stage ¼ wavelength resonant electrode 130*b*. The resonant electrode coupling conductor 132 has a region that faces the ground end side of the second input/output-stage ¼ wavelength resonant electrode 130*b* such that the electromagnetic field coupling is generated between the resonant electrode coupling conductor 132 and the second input/output-stage ¼ wavelength resonant electrode 130*b*. In a central portion, the resonant electrode coupling conductor 132 has a region that faces both the other end side from the center of the one-end-side region of the input/output-stage ½ wavelength resonant electrode 130*f* and one end side from the center of the-other-end-side region of the input/output-stage ½ wavelength resonant electrode 130*f*.

An annular ground electrode 123 is formed in the first inter-layer IL3 of the laminate so as to surround the input/output-stage ½ wavelength resonant electrode 130*f*, the central-stage ½ wavelength resonant electrode 130*c*, the first central-stage ¼ wavelength resonant electrode 130*d*, the second central-stage ¼ wavelength resonant electrode 130*e*, the first input/output-stage ¼ wavelength resonant electrode 130*a*, and the second input/output-stage ¼ wavelength resonant electrode 130*b*. The annular ground electrode 123 is connected to ground terminals of the first central-stage ¼ wavelength resonant electrode 130*d*, second central-stage ¼ wavelength resonant electrode 130*e*, first input/output-stage ¼ wavelength resonant electrode 130*a*, and second input/output-stage ¼ wavelength resonant electrode 130*b*. One end of the resonant electrode coupling conductor 132 is connected to the first ground electrode 21 and annular ground electrode 123 through a penetration conductor 150*a* near the ground terminal of the first input/output-stage ¼ wavelength resonant electrode 130*a*, and the other end is connected to the first ground electrode 21 and annular ground electrode 123 through a penetration conductor 150*b* near the ground terminal of the second input/output-stage ¼ wavelength resonant electrode 130*b*.

In the first coupling electrode 140*a*, a first input/output point 145*a* is located so as to face the open end side from the center of the first input/output-stage ¼ wavelength resonant electrode 130*a*. The first input/output point 145*a* is connected to a penetration conductor 150*c*, and one of differential signals is fed into or supplied from the first input/output point 145*a*. In the second coupling electrode 140*b*, a second input/output point 145*b* is located so as to face the open end side from the center of the second input/output-stage ¼ wavelength resonant electrode 130*b*. The second input/output point 145*b* is connected to a penetration conductor 150*d*, and the other of the differential signals is fed into or supplied from the second input/output point 145*b*. In the third coupling electrode 140*c*, a third input/output point 145*c* is located so as to face one end side from the center of the one-end-side region of the input/output-stage ½ wavelength resonant electrode 130*f*. The third coupling electrode 140*c* is connected to a penetration conductor 150*e*, and one of differential signals is fed into or supplied from the third coupling electrode 140*c*. In the fourth coupling electrode 140*d*, a fourth input/output point 145*d* is located so as to face the other end side from the center of the-other-end-side region of the input/output-stage ½ wavelength resonant electrode 130*f*. The fourth input/output point 145*d* is connected to a penetration conductor 150*f*, and the other of the differential signals is fed into or supplied from the fourth input/output point 145*d*.

The electromagnetic field coupling is generated between the first input/output-stage ¼ wavelength resonant electrode 130*a* and second input/output-stage ¼ wavelength resonant electrode 130*b* and the central-stage ½ wavelength resonant electrode 130*c* in an interdigital manner, the electromagnetic field coupling is generated between the central-stage ½ wavelength resonant electrode 130*c* and the first central-stage ¼ wavelength resonant electrode 130*d* and second central-stage ¼ wavelength resonant electrode 130*e* in the interdigital manner, and the electromagnetic field coupling is generated between the first central-stage ¼ wavelength resonant electrode 130*d* and second central-stage ¼ wavelength resonant electrode 130*e* and the input/output-stage ½ wavelength resonant electrode 130*f* in the interdigital manner. Accordingly, the electromagnetic field coupling is generated in all the adjacent resonant electrodes in the interdigital manner. The coupling by the electric field and the coupling by the magnetic field are added to generate the coupling stronger than that of comb-line type coupling. Therefore, a frequency interval between resonant frequencies in each resonant mode can properly be set to obtain a largely wide passband width having a fractional bandwidth of about 40%. The passband width having the fractional bandwidth of about 40% far exceeds the region that can be realized with the filter in which the conventional ¼ wavelength resonator is used.

The first coupling electrode 140*a* and second coupling electrode 140*b* and the first input/output-stage ¼ wavelength resonant electrode 130*a* and second input/output-stage ¼ wavelength resonant electrode 130*b* are broad-side coupled and coupled in the interdigital manner. The third coupling electrode 140*c* and fourth coupling electrode 140*d* and the one-end-side region and the-other-end-side region of the input/output-stage ½ wavelength resonant electrode 130*f* are broad-side coupled and coupled in the interdigital manner. The broad-side coupling is stronger than the edge coupling. Further, because the coupling is performed in the interdigital manner, as with the above-described coupling between the resonant electrodes, the coupling by the magnetic field and the coupling by the electric field are added to generate the strong coupling. Therefore, the significantly strong coupling is generated between the first coupling electrode 140*a* and second coupling electrode 140*b* and the first input/output-stage ¼ wavelength resonant electrode 130*a*, between the first coupling electrode 140*a* and second coupling electrode 140*b* and the second input/output-stage ¼ wavelength resonant electrode 130*b*, and between the third coupling electrode 140*c* and fourth coupling electrode 140*d* and the one-end-side region and the-other-end-side region of the input/output-stage ½ wavelength resonant electrode 130*f*, which allows the novel bandpass filter to be obtained. In the novel bandpass filter, even in the passband that far exceeds the region that can be realized with the filter in which the conventional ¼ wavelength resonator is used, the insertion loss is not largely increased in the frequency located between the resonant frequency in each resonant mode, the insertion loss becomes flat in the whole region of the passband, and the low-loss bandpass characteristic can be obtained.

Two filter circuits are connected in parallel. One of the filter circuits comprises the four-stage resonant electrode having the first input/output-stage ¼ wavelength resonant electrode 130*a*, the one-end-side region of the central-stage ½ wavelength resonant electrode 130*c*, and the one-end-side regions of the first central-stage ¼ wavelength resonant electrode 130*d* and input/output-stage ½ wavelength resonant electrode 130*f*. The other filter circuit comprises the four-stage resonant electrode having the second input/output-stage ¼ wavelength resonant electrode 130*b*, the-other-end-side region of the central-stage ½ wavelength resonant electrode 130*c*, and the-other-end-side regions of the second central-stage ¼ wavelength resonant electrode 130*e* and input/output-stage ½ wavelength resonant electrode 130*f*. In each filter circuit including the four-stage resonant electrode, inductive coupling is generated by the resonant electrode coupling conductor 132 between the first-stage resonant electrode and the last-stage resonant electrode. In each filter circuit, the adjacent resonant electrodes are coupled in the interdigital manner, and the coupling by the magnetic field and the coupling by the electric field are added to generate the strong coupling. However, in the filter circuit, capacitive coupling is generated as a whole. Therefore, a phase difference of 180° is generated between a signal that is transmitted by the inductive coupling between the first-stage resonant electrode and the last-stage resonant electrode of the filter circuit including the four-stage resonant electrode through the resonant electrode coupling conductor 132 and a signal that is transmitted by the capacitive coupling between the adjacent resonant electrodes, so that a phenomenon in which the signals are cancelled each other can be generated. Because the phenomenon can be generated near both sides of the passband of the bandpass filter, an attenuation pole in which the signal is hardly transmitted can be formed near both sides of the passband in the bandpass characteristic of the bandpass filter.

The annular ground electrode 123 is formed in the first inter-layer IL1 of the laminate so as to surround the input/output-stage ½ wavelength resonant electrode 130*f*, the central-stage ½ wavelength resonant electrode 130*c*, the first central-stage ¼ wavelength resonant electrode 130*d*, the second central-stage ¼ wavelength resonant electrode 130*e*, the first input/output-stage ¼ wavelength resonant electrode 130*a*, and the second input/output-stage ¼ wavelength resonant electrode 130*b*. Therefore, the ground terminals of the first input/output-stage ¼ wavelength resonant electrode 130*a*, second input/output-stage ¼ wavelength resonant electrode 130*b*, first central-stage ¼ wavelength resonant electrode 130*d*, and second central-stage ¼ wavelength resonant electrode 130*e* can easily be grounded by connecting the ground terminals to the annular ground electrode 123. By electromagnetically shielding the surround of each resonant electrode, an influence of an external electromagnetic noise can be reduced while a leakage of an electromagnetic wave generated from each resonant electrode to the surround can be reduced. The effect is particularly useful to prevent the adverse effect to other regions of the module board when the bandpass filter is formed in part of the region of the module board.

Even though an example has been described in the embodiments where the input/output terminal electrode 160*a*, 160*b*, 160*c* and 160*d* are provided, the input/output terminal electrodes 160*a*, 160*b*, 160*c* and 160*d* are not necessary in a case where the bandpass filter is formed on a region of the module substrate.

For example, an input wiring electrode from an external circuit in the module substrate and an output wiring electrode to the external circuit in the module substrate may be directly connected to one of the coupling electrodes 140*a*, 140*b*, 140*c* and 140*d*. In this case, contact points of the coupling electrode 140*a*, 140*b*, 140*c* and an electrical signal inputted from or outputted to the external circuit is supplied to the input/output coupling electrodes 145*a*, 145*b*, 145C and 145*d*.

In addition, the bandpass filter 900 shown in FIGS. 9 and 10 comprises one resonance coupling conductor 132. However, the number of the resonance coupling conductors is not limited to one. A bandpass filter may comprise two or more resonance coupling conductors.

In one embodiment, a bandpass filter may have two or more resonance coupling electrodes.

Figure 11:
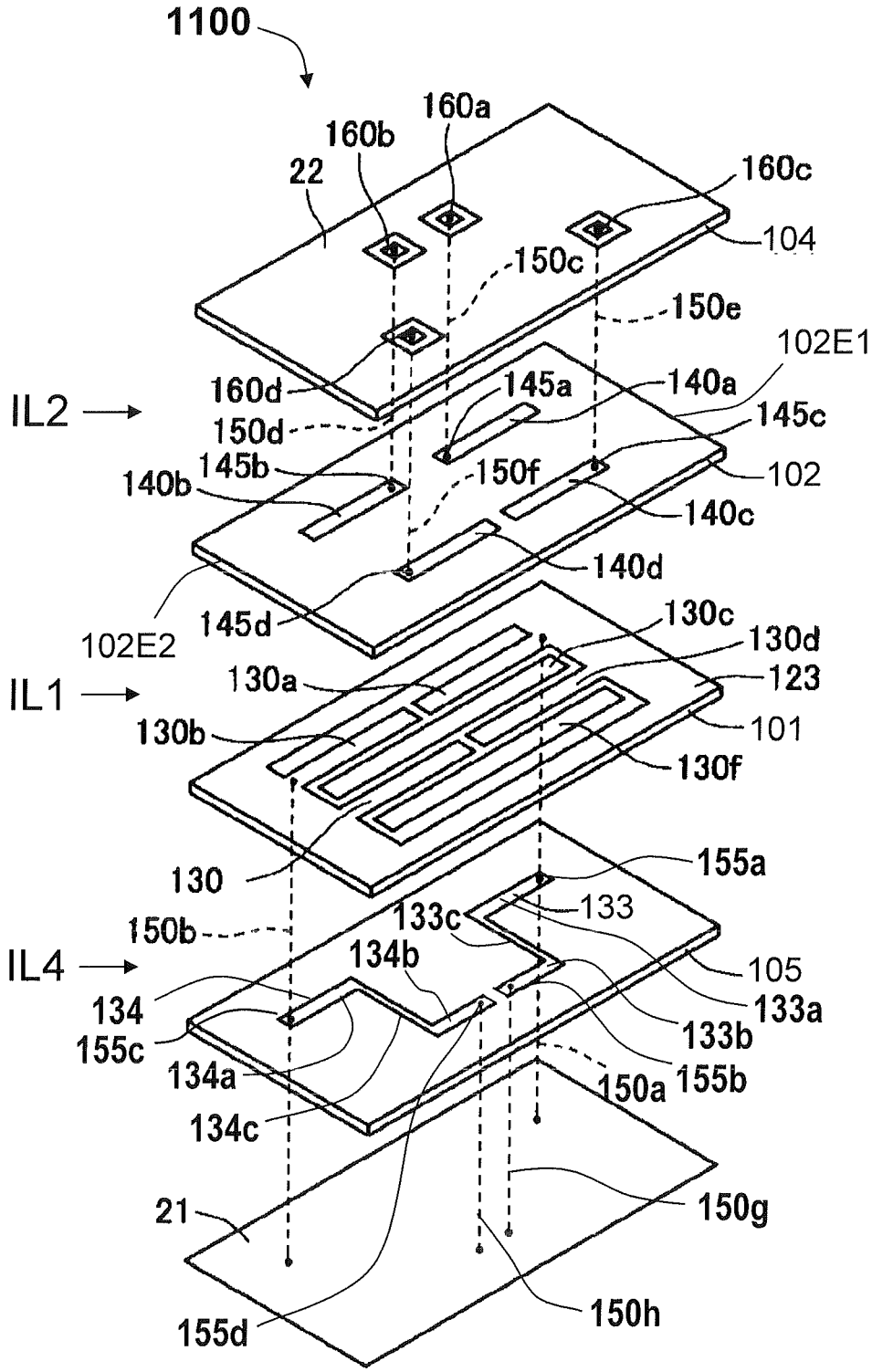
FIG. 11 is an exploded perspective view schematically illustrating the bandpass filter according to one embodiment of the present invention.

FIG. 11 is an exploded perspective view schematically illustrating a bandpass filter 1100 according to one embodiment of the present invention. Referring to FIG. 11, the bandpass filter 1100 comprises two resonance coupling electrodes, a first resonance coupling electrode 133 and a second resonance coupling electrode 134. The resonant electrode coupling conductors 133 and 134 are disposed on the dielectric layer 105.

The first resonance coupling electrode 133 comprises a first portion 133*a*, a second portion 133*b* and a third portion 133*c*. The third portion 133*c* electrically connects the first portion 133*a* with the second portion 133*b*. The first portion 133*a* comprises a first end. The first portion 133*a* also comprises a first connection point 155*a* near the first end. The second portion 133*b* comprises a second end. The second portion 133*b* also comprises a second connection point 155*b* near the second end.

The second resonance coupling electrode 134 comprises a fourth portion 134*a*, a fifth portion 134*b* and a sixth portion 134*c*. The fourth portion 134*a* comprises a third end. The fourth portion 133*a* also comprises a third connection point 155*c* near the third end. The fifth portion 134*b* comprises a fourth end. The fifth portion 134*b* also comprises a fourth connection point 155*d* near the fourth end. The third portion 134*c* electrically connects the first portion 134*a* with the second portion 134*b*.

The first connection point 155*a* and the third connection point 155*c* are electrically connected to the first ground 21 via a penetration conductor 150*a* and 150*c*, respectively. The second connection point 155*b* and the fourth connection point 155*d* are electrically connected to the first ground 21 via a penetration conductor 150*g* and 150*h*, respectively.

The first part 133*a* faces the first input/output-stage ¼ wavelength resonant electrode 130*a* such that the electromagnetic field coupling is generated between the resonant electrode coupling conductor 133 and the input/output-stage ¼ wavelength resonant electrode 130*a*. The second portion 133*b* faces the second input/output-stage ¼ wavelength resonant electrode 130*b* such that the electromagnetic field coupling is generated between the resonant electrode coupling conductor 133 and the second input/output-stage ¼ wavelength resonant electrode 130*b*.

The first part 134*a* faces one-end-side region of the input/output-stage ½ wavelength resonant electrode 130*f* such that the electromagnetic field coupling is generated between the resonant electrode coupling conductor 134 and the input/output-stage ½ wavelength resonant electrode 130*f*. The second portion 134*b* faces the other-end-side region of the input/output-stage ½ wavelength resonant electrode 130*f* such that the electromagnetic field coupling is generated between the resonant electrode coupling conductor 133 and the input/output-stage ½ wavelength resonant electrode 130*f*.

Figure 12:
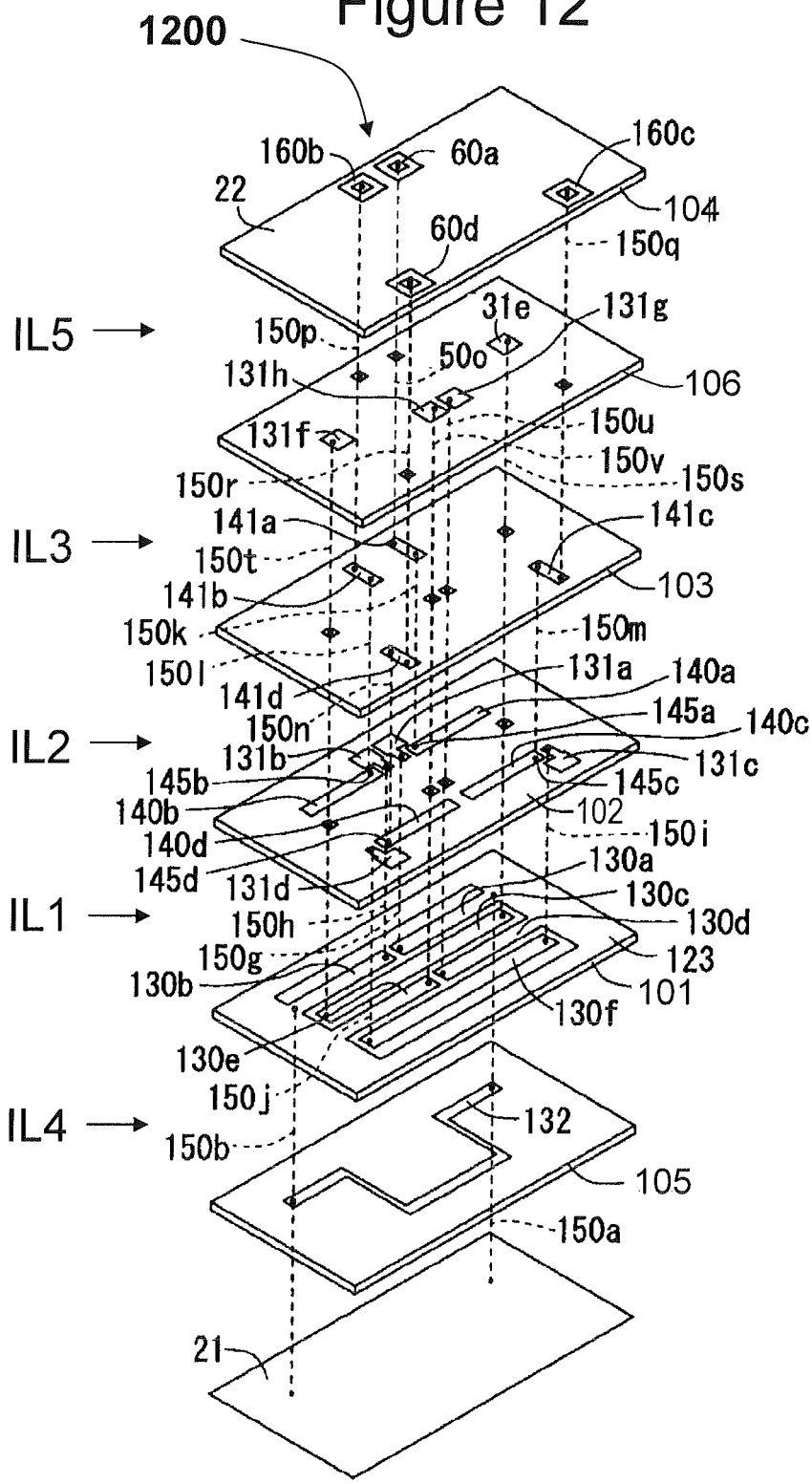
FIG. 12 is an exploded perspective view schematically illustrating the bandpass filter according to one embodiment of the present invention.

FIG. 12 is an exploded perspective view schematically illustrating a bandpass filter 1200 according to an embodiment of the present invention. The following descriptions focus on only the differences from the embodiment shown in FIG. 10, wherein the same reference numerals refer to the same constitutional elements, and therefore, the repetitive descriptions will be omitted.

In a bandpass filter 1200 of FIG. 12, a first auxiliary resonant electrode 131*a* that is connected to the open end side of the first input/output-stage ¼ wavelength resonant electrode 130*a* by a penetration conductor 150*g*, a second auxiliary resonant electrode 131*b* that is connected to the open end side of the second input/output-stage ¼ wavelength resonant electrode 130*b* by a penetration conductor 150*h*, a third auxiliary resonant electrode 131*c* that is connected to one end side in the one-end-side region of the input/output-stage ½ wavelength resonant electrode 130*f* by a penetration conductor 150*i*, and a fourth auxiliary resonant electrode 131*d* that is connected to the other end side in the-other-end-side region of the input/output-stage ½ wavelength resonant electrode 130*f* by a penetration conductor 150*j* are disposed in the second inter-layer IL2 of the laminate. The first auxiliary resonant electrode 131*a*, the second auxiliary resonant electrode 131*b*, the third auxiliary resonant electrode 131*c*, and the fourth auxiliary resonant electrode 131*d* are disposed so as to have the regions facing the annular ground electrode 123, respectively.

The bandpass filter 1200 of FIG. 12 comprises a first auxiliary coupling electrode 141*a*, a second auxiliary coupling electrode 141*b*, a third auxiliary coupling electrode 141*c*, and a fourth auxiliary coupling electrode 141*d* in a third inter-layer IL3 that is located across the second inter-layer IL2 from the first inter-layer IL1. The first auxiliary coupling electrode 141*a* is connected to the first input/output point 145*a* of the first coupling electrode 140*a* by a penetration conductor 150*k*, and is disposed so as to have a region facing the first auxiliary resonant electrode 131*a*. The second auxiliary coupling electrode 141*b* is connected to the second input/output point 145*b* of the second coupling electrode 140*b* by a penetration conductor 150*l*, and is disposed so as to have a region facing the second auxiliary resonant electrode 131*b*. The third auxiliary coupling electrode 141*c* is connected to the third input/output point 145*c* of the third coupling electrode 140*c* by a penetration conductor 150*m*, and is disposed so as to have a region facing the third auxiliary resonant electrode 131*c*. The fourth auxiliary coupling electrode 141*d* is connected to the fourth input/output point 145*d* of the fourth coupling electrode 140*d* by a penetration conductor 150*n*, and is disposed so as to have a region facing the fourth auxiliary resonant electrode 131*d*.

A first input/output terminal electrode 160*a* and a second input/output terminal electrode 160*b* are connected to the first auxiliary coupling electrode 141*a* and the second auxiliary coupling electrode 141*b* through penetration conductors 150*o* and 150*p*, respectively. A third input/output terminal electrode 160*c* and a fourth input/output terminal electrode 160*d* are connected to the third auxiliary coupling electrode 141*c* and the fourth auxiliary coupling electrode 141*d* through penetration conductors 150*q* and 150*r*, respectively. The differential signals are fed and supplied between the first coupling electrode 140*a* and second coupling electrode 140*b* and an external circuit through the first input/output terminal electrode 160*a* and second input/output terminal electrode 160*b*, the first auxiliary coupling electrode 141*a* and second auxiliary coupling electrode 141*b*, and the penetration conductors 150*o* and 150*p*. The differential signals are fed and supplied between the third coupling electrode 140*c* and fourth coupling electrode 140*d* and the external circuit through the third input/output terminal electrode 160*c* and fourth input/output terminal electrode 160*d*, and the third auxiliary coupling electrode 141*c* and fourth auxiliary coupling electrode 141*d*, and the penetration conductors 150*q* and 150*r*, thereby acting as a bandpass filter in which the differential input/output can be performed.

The bandpass filter 1200 of FIG. 12 further comprises an auxiliary resonant electrode 131*e*, an auxiliary resonant electrode 131*f*, an auxiliary resonant electrode 131*g*, and an auxiliary resonant electrode 131*h* in a fifth inter-layer IL25 located between the first inter-layer IL1 of the laminate and the upper surface of the laminate so as to face the second ground electrode 22. The auxiliary resonant electrode 131*e* and the auxiliary resonant electrode 131*f* are connected to one end side and the other end side of the central-stage ½ wavelength resonant electrode 130*c* by penetration conductors 150*s* and 150*t*, respectively. The auxiliary resonant electrode 131*g* and the auxiliary resonant electrode 131*h* are connected to the open end sides of the first central-stage ¼ wavelength resonant electrode 130*d* and second central-stage ¼ wavelength resonant electrode 130*e* by penetration conductors 150*u* and 150*v*, respectively.

The coupling by the electromagnetic field between the first auxiliary coupling electrode 141*a* and second auxiliary coupling electrode 141*b* and the first auxiliary resonant electrode 131*a* and second auxiliary resonant electrode 131*b* is added to the coupling by the electromagnetic field between the first coupling electrode 140*a* and second coupling electrode 140*b* and the first input/output-stage ¼ wavelength resonant electrode 130*a* and second input/output-stage ¼ wavelength resonant electrode 130*b*.

The coupling by the electromagnetic field between the third auxiliary coupling electrode 141*c* and fourth auxiliary coupling electrode 141*d* and the third auxiliary resonant electrode 131*c* and fourth auxiliary resonant electrode 131*d* is added to the coupling by the electromagnetic field between the third coupling electrode 140*c* and fourth coupling electrode 140*d* and the one-end-side region and the-other-end-side region of the input/output-stage ½ wavelength resonant electrode 130*f*.

Therefore, the coupling by the electromagnetic field between the first coupling electrode 140*a* and second coupling electrode 140*b* and the first input/output-stage ¼ wavelength resonant electrode 130*a* and a second input/output-stage ¼ wavelength resonant electrode 130*b* and the coupling by the electromagnetic field between the third coupling electrode 140*c* and fourth coupling electrode 140*d* and the one-end-side region and the-other-end-side region of the input/output-stage ½ wavelength resonant electrode 130*f* are further strengthened.

The first auxiliary resonant electrode 131*a*, the second auxiliary resonant electrode 131*b*, the third auxiliary resonant electrode 131*c*, and the fourth auxiliary resonant electrode 131*d* are disposed so as to have the regions facing the annular ground electrode 123, respectively. The auxiliary resonant electrode 131*e*, the auxiliary resonant electrode 131*f*, the auxiliary resonant electrode 131*g*, and the auxiliary resonant electrode 131*h* are disposed so as to have the regions facing the second ground electrode 22. A length of the resonant electrode connected to each auxiliary resonant electrode is shortened by an electrostatic capacitance generated between each auxiliary resonant electrode and the annular ground electrode 23 or second ground electrode 22, so that the compact bandpass filter can be obtained.

A wireless communication module and a radio communication device according to one embodiment of the invention may use any one of the bandpass filters mentioned in the above embodiments.

Figure 13:
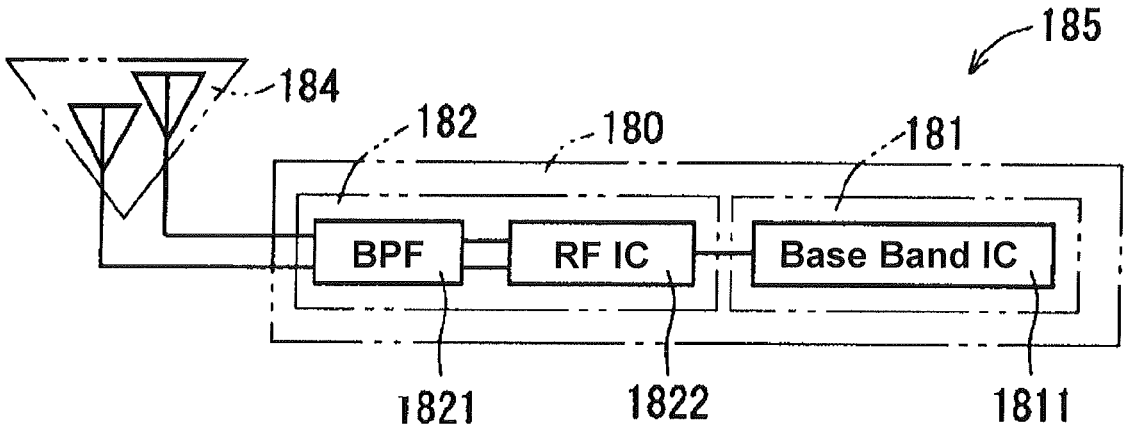
FIG. 13 is a block diagram illustrating a constructional example of a wireless communication device using the bandpass filter according to one embodiment of the present invention.

FIG. 13 is a block diagram illustrating a constructional example of a wireless communication module 180 and a radio communication device 185 using the wireless communication module 180 according to an embodiment of the present invention, which utilizes a bandpass filter according to the embodiments of the present invention.

The wireless communication module 180 comprises a base band module 181 that performs a processing of a base band signal, and a RF module connected to the base band module 181 and configured to perform a RF signal processing before modulating the base band signal and after reconstructing the signal.

The RF module 182 comprises the bandpass filter 1821. The bandpass filter 1821 can reduce RF signals modulated of the base band signal or received RF signals at a frequency range other than the pass band.

Specifically, the base band module comprises a base band IC 1811, and RF module 182 comprises a RF IC 1822 between the pass filter 1821 and base band module 181. It is not needless to say that the wireless communication can comprise another circuit between these modules.

The wireless communication device 85 further comprises an antenna 184 connected to the bandpass filter 1821 of the high frequency module 180. When passing through the bandpass filter 1821, a transmission signal outputted from the wireless communication device 185 is transmitted through the antenna 84. When passing through the bandpass filter 1821, a receipt signal received through the antenna 84 enters into the wireless communication device 185, with the signals having frequencies other than the communication band attenuated.

In the bandpass filters according to the embodiments of the present invention, the dielectric layers 111 may comprise a resin such as epoxy resin, or ceramics such as dielectric ceramics. For example, a glass-ceramic material may be appropriately used which comprises a dielectric ceramic material such as $BaTiO_3$, $Pb_4Fe_2Nb_2O_{12}$, $TiO_2$ and a glass material such as $B_2O_3$, $SiO_2$, $Al_2O_3$, ZnO and may be sinterable at a relatively low temperature of about 800° C. to 1200° C. Further, the thickness of the dielectric layers 111 is set, for example, to about 0.05 to 0.4 mm.

A conductive material whose principle constituent is an Ag alloy of, for example, Ag, Ag—Pd, and Ag—Pt or Cu-based, W-based, Mo-based, and Pd-based conductive material is fairly appropriately used for the above-described various electrodes and penetration conductors. The thickness of the various electrodes is set, for example, on the order of 0.001 to 0.03 mm.

The bandpass filters according to the above embodiments may be manufactured, for example, as follows. To begin with, a proper organic solvent is added to ceramic based powder and mixed to form a slurry and then form a ceramic green sheet by a doctor blade method. Next, through-holes for penetration conductors, are formed at the obtained ceramic green sheet using a punching machine, and conductive paste such as Ag, Ag—Pd, Au, and Cu, is filled in the through-holes to form penetration conductors. Thereafter, the above described various electrodes are formed on the ceramic green sheet by lithography. Then, these are stacked and pressurized by a hot press device, and fired at a high temperature of 800° C. to 1050° C.

Example 1

Electrical properties of the bandpass filter comprising a structure as shown in FIGS. 5 to 8 were calculated by simulation using a finite element method. The following conditions were used for calculation: relative dielectric constant of the dielectric layers is 9.4; dissipation factor of the dielectric layers is 0.0005; and conductivity of various electrodes is $3.0*10^7$ S/m.

In the above embodiments, the auxiliary resonance electrodes 131*a*, 131*b*, 131*c*, and 131*d* face the annular ground electrode 123. Alternatively, the auxiliary resonance electrodes 131*a*, 131*b*, 131*c*, and 131*d* may face the first ground electrode 21 or the second ground electrode 22.

In the above embodiments, the first ground electrode 21 is located on the bottom surface of the laminate. Alternatively, a dielectric layer may be located below the first ground electrode 21. In the same manner, a dielectric layer may be located on the second ground electrode 22.

As the shape measurements, the input and output resonance electrodes 30*a*, 30*b* were adapted to have the width of 0.4 mm, the length of 5.8 mm, the central resonance electrodes 30*c*, 30*d* were adapted to have the width of 0.4 mm, the length of 2.9 mm, and the interval of 0.13 mm between two adjacent resonance electrodes.

The input coupling electrodes 40*a*, 40*c* and the output coupling electrodes 40*b*, 40*d* were adapted to have the width of 0.3 mm and the length of 2.5 mm, and the auxiliary input coupling electrodes 41*a*, 41*c* and the auxiliary output coupling electrodes 41*b*, 41*d* were adapted to have the width of 0.3 mm and the length of 1.45 mm.

Each of the auxiliary resonance electrodes 31*a*, 31*b*, 31*c* and 31*d* was adapted to have a first rectangular portion and a second rectangular portion joined to each other; the first rectangular portion is arranged 0.3 mm away from an end of each of the resonance electrodes 30*a* and 30*b*, respectively, and has the width of 0.45 mm and the length of 0.8 mm; and the second rectangular portion is located from the first rectangular portion toward each of the resonance electrodes 30*a* and 30*b* and has the width of 0.2 mm and the length of 0.4 mm.

The third ground electrode was adapted to have a rectangular shape which has the width of 0.4 mm and the length of 0.8 mm. Each of the input terminal electrode 60*a* and the output terminal electrode 60*b* were adapted to have a square portion whose one edge is 0.3 mm long and to be 0.2 mm away from the second ground electrode 22.

In the external appearance, each of the first ground electrode 21, the second ground electrode 22, and the annular ground electrode 23 was adapted to have the width of 3 mm and the length of 8 mm, and the opening portion of the annular ground electrode 23 was adapted to have the width of 2.4 mm and the length of 6 mm.

The bandpass filter was overall adapted to have the width of 3 mm, the length of 8 mm, and the thickness of 0.91 mm, and to have the dielectric layer 101, on which resonance electrodes 30*a*, 30*b*, 30*c* and 30*d* are located, at the center thereof in the thickness direction. The thickness of the dielectric layer was adapted to be 0.065 mm. The thickness of various electrodes was adapted to be 0.01 mm, and the diameter of various penetration conductors was adapted to be 0.1 mm.

Figure 14:
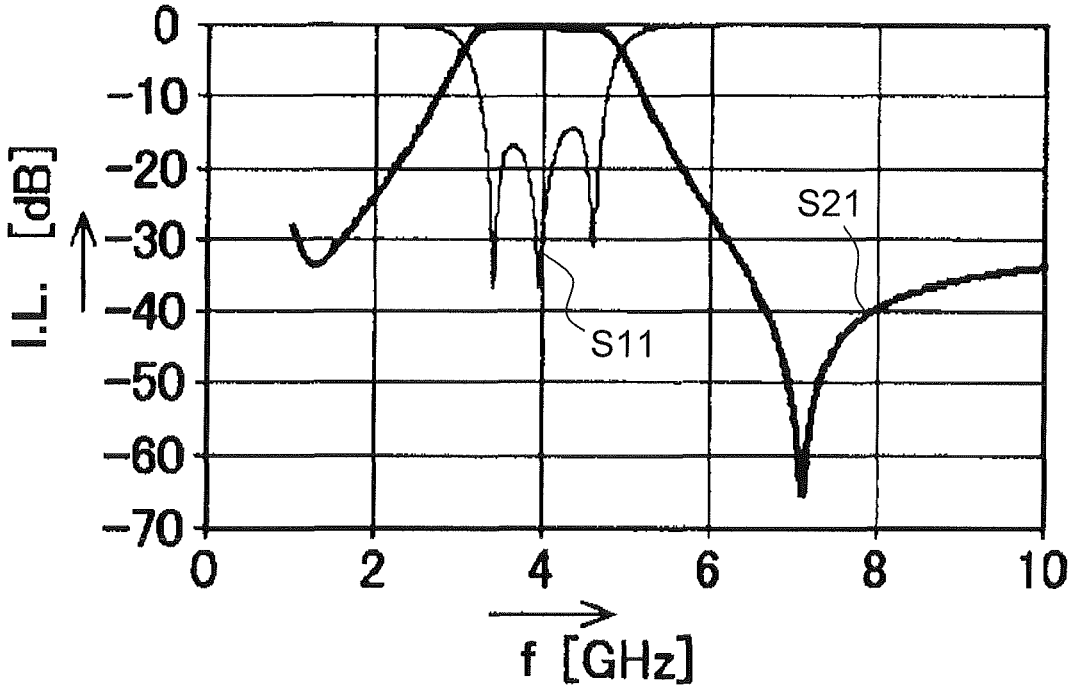
FIG. 14 is a graph showing a result of simulation regarding an electrical characteristic of the bandpass filter shown in FIGS. 5 to 8.

FIG. 14 is a graph illustrating a result of the simulation regarding an electrical characteristic of the bandpass filter, wherein horizontal axis refers to frequencies, vertical axis refers to losses, S21 refers to a transmission characteristic, and S11 refers to a reflection characteristic.

The graph illustrated in FIG. 14 shows the pass characteristics (S21) of the Loss of less than 1.5 dB occurs in the frequency range of 3.2 GHz to 4.7 GHz that corresponds to 40% by the relative bandwidth, which is even broader than the region realized by the conventional filter using the conventional ¼ wavelength resonator. As such, it could be possible to achieve an excellent transmission characteristic of being flat and of low loss over the entire region of the broad pass band and therefore the effectiveness of the present invention might be verified.

Example 2

The transmission properties of the bandpass filter having the structure according to FIG. 12 were calculated by electromagnetic simulation. The following conditions were used for calculation: relative dielectric constant of the dielectric layer 11 is 9.4; dissipation factor is 0.0005; and conductivity is $3.0*10^7$ S/m.

As the shape measurements of the design values used for the trial production, the first and second input/output ¼ resonance electrodes 130*a*, 130*b* and the first and second ¼ central resonance electrodes 130*d*, 130*e* were adapted to have the width of 0.4 mm, the length of 2.9 mm. The input/output ½ resonance electrode 130*f* and the ½ central resonance electrode 130*c* were adapted to have the width of 0.4 mm, the length of 5.8 mm, and each interval of neighboring resonance electrodes was 0.13 mm.

The first to fourth coupling electrodes 140*a*, 140*b*, 140*c* and 140*d* were adapted to have the width of 0.3 mm and the length of 2.5 mm, and the auxiliary coupling electrodes 141*a*, 141*b*, 141*c* and 141*d* were adapted to have the width of 0.3 mm and the length of 1.4 mm. Each of the first to fourth auxiliary resonance electrodes 131*a*, 131*b*, 131*c*, and 131*d* was adapted to have a first rectangular portion and a second rectangular portion joined to each other, wherein the first rectangular portion has the width of 0.55 mm, the length of 0.6 mm, and the second rectangular portion has the width of 0.2 mm and the length of 0.7 mm.

Each of the auxiliary resonance electrodes 131*e*, 131*f*, 131*g* and 131*h* was adapted to have a rectangular shape with the width of 0.65 mm and the length of 0.7 mm.

In the external appearance, each of the first ground electrode 21, the second ground electrode 22, and the annular ground electrode 123 was adapted to have the width of 4.6 mm and the length of 7.1 mm. The opening portion of the annular ground electrode 123 was adapted to have the width of 2.9 mm and the length of 6 mm.

Each of the input terminal electrode 60*a* and the output terminal electrode 60*b* was adapted to have a square portion whose one edge is 0.3 mm long and to be 0.2 mm away from the second ground electrode 22.

The bandpass filter was overall adapted to have the width of 4.6 mm, the length of 7.1 mm, and the thickness of 0.91 mm, and to have the upper surface of the dielectric layer 101 at the center thereof in the thickness direction. That is, the first inter-layer portion is at the center of the bandpass filter in the thickness direction.

The first portion 132*a* of the resonance electrode coupling conductor 132 has a rectangular shape with the width of 0.2 mm and the length of 1.7 mm. The second portion 132*b* of the resonance electrode coupling conductor 132 has a rectangular shape with the width of 0.2 mm and the length of 1.7 mm. The third portion 132*c* of the resonance electrode coupling conductor 132 has a rectangular shape with the width of 0.2 mm and the length of 3.2 mm. Each of the connection portions 132*d* and 132*f* of the resonance electrode coupling conductor 132 has a rectangular shape with the width of 0.1 mm.

The thickness of each of the dielectric layers 101, 102, 103, 104, 105 and 106 was adapted to be 0.065 mm. That is, the distance between neighboring inter-layer portions is 0.065 mm. The thickness of various electrodes was adapted to be 0.01 mm, and the diameter of various penetration conductors was adapted to be 0.1 mm.

Figure 15:
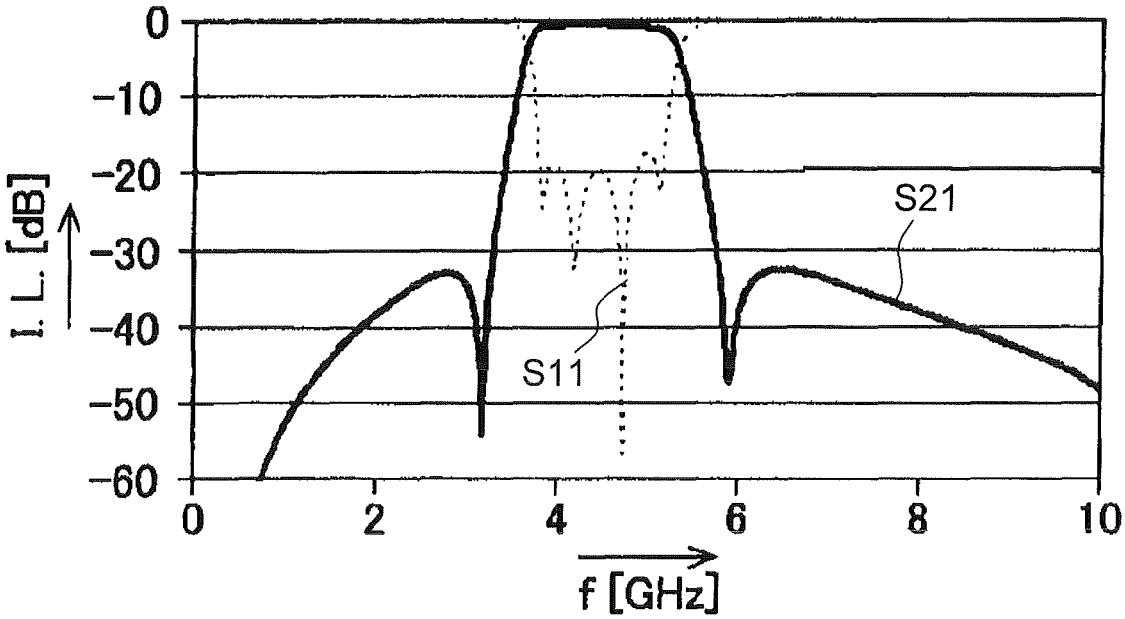
FIG. 15 is a graph showing a result of simulation regarding an electrical characteristic of the bandpass filter shown in FIG. 12.

FIG. 15 is a graph illustrating a result of the simulation regarding an electrical characteristic of the bandpass filter, wherein horizontal axis refers to frequencies, vertical axis refers to losses, S21 refers to a transmission characteristic, and S11 refers to a reflection characteristic.

Figure 16:
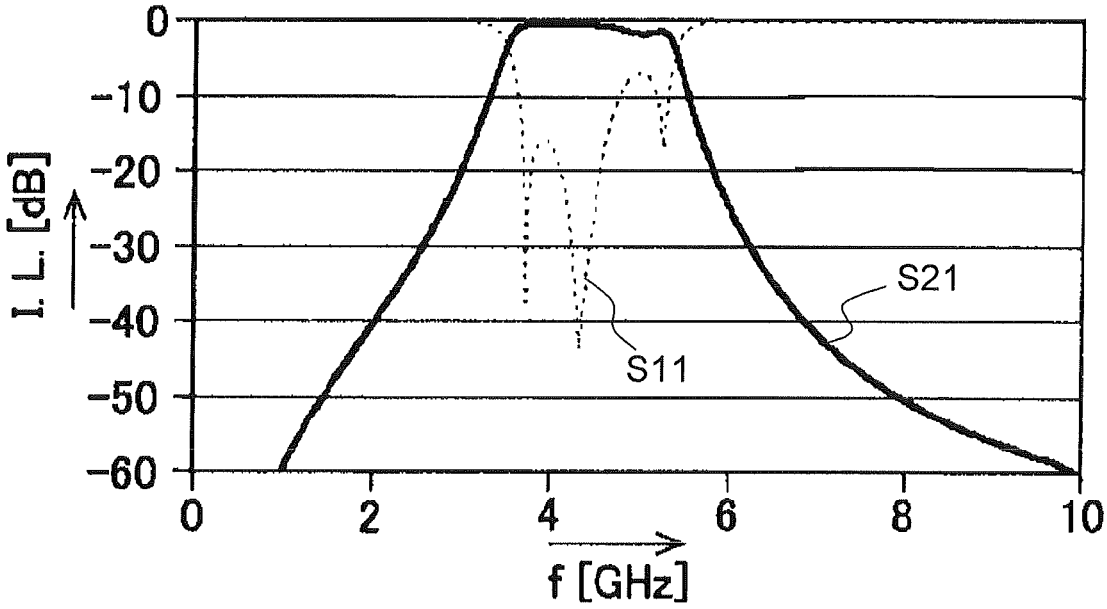
FIG. 16 is a graph showing a result of simulation regarding an electrical characteristic of an existing bandpass filter.

In the meanwhile, the transfer properties of the comparative bandpass filter having the configuration without the resonance electrode coupling conductor 132 shown in FIG. 12 were calculated by electromagnetic simulation. FIG. 16 shows a graph illustrating a result of the simulation regarding the transfer properties of the comparative bandpass filter wherein horizontal axis refers to frequencies, vertical axis refers to losses, S21 refers to a transmission characteristic, and S11 refers to a reflection characteristic.

The graph illustrated in FIG. 15 shows that the band pass filter has a loss in a wide frequency range that corresponds to 40% to 50% by the relative bandwidth than the existing filter having ¼ wavelength resonator.

In addition, compared to the transfer characteristics shown in the graph illustrated in FIG. 16, the bandpass filter has two attenuation poles obtained at the lower band side and at the higher band side than the pass band near the pass band, and has an abrupt attenuation characteristic near the both cutoff frequencies.

While at least one exemplary embodiment has been presented in the foregoing detailed description, the present disclosure is not limited to the above-described embodiment or embodiments. Variations may be apparent to those skilled in the art. In carrying out the present disclosure, various modifications, combinations, sub-combinations and alterations may occur in regard to the elements of the above-described embodiment insofar as they are within the technical scope of the present disclosure or the equivalents thereof. The exemplary embodiment or exemplary embodiments are examples, and are not intended to limit the scope, applicability, or configuration of the disclosure in any way. Rather, the foregoing detailed description will provide those skilled in the art with a template for implementing the exemplary embodiment or exemplary embodiments. It should be understood that various changes can be made in the function and arrangement of elements without departing from the scope of the disclosure as set forth in the appended claims and the legal equivalents thereof. Furthermore, although embodiments of the present disclosure have been described with reference to the accompanying drawings, it is to be noted that changes and modifications may be apparent to those skilled in the art. Such changes and modifications are to be understood as being included within the scope of the present disclosure as defined by the claims.

Terms and phrases used in this document, and variations hereof, unless otherwise expressly stated, should be construed as open ended as opposed to limiting. As examples of the foregoing: the term "including" should be read as mean "including, without limitation" or the like; the term "example" is used to provide exemplary instances of the item in discussion, not an exhaustive or limiting list thereof; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent. The term "about" when referring to a numerical value or range is intended to encompass values resulting from experimental error that can occur when taking measurements.

The invention claimed is:

1. A bandpass filter, comprising:

a laminate comprising a plurality of dielectric layers;

a ground electrode on or in the laminate;

a first ½ wavelength resonance electrode and a second ½ wavelength resonance electrode in a first inter-layer portion of the laminate, in parallel with each other, and each having a strip shape and two open ends;

a first ¼ wavelength resonance electrode between the first ½ wavelength resonance electrode and the second ½ wavelength resonance electrode in the first inter-layer portion, having a strip shape, comprising a ground end and an open end, in parallel to a first half portion of the first ½ wavelength resonance electrode and a first half portion of the second ½ wavelength resonance electrode, sandwiched by the first half portion of the first ½ wavelength resonance electrode and the first half portion of the second ½ wavelength resonance electrode, operable to electromagnetically couple with the first half portion of the first ½ wavelength resonance electrode and the first half portion of the second ½ wavelength resonance electrode;

a second ¼ wavelength resonance electrode between the first ½ wavelength resonance electrode and the second ½ wavelength resonance electrode in the first inter-layer portion, having a strip shape, comprising a ground end and an open end, in parallel to a second half portion of the first ½ wavelength resonance electrode and a second half portion of the second ½ wavelength resonance electrode, sandwiched by the second half portion of the first ½ wavelength resonance electrode and the second half portion of the second ½ wavelength resonance electrode, and operable to electromagnetically couple with the second half portion of the first ½ wavelength resonance electrode and the second half portion of the second ½ wavelength resonance electrode;

a first coupling electrode in a second inter-layer portion of the laminate, having a strip shape, facing the first half portion of the first ½ wavelength resonance electrode, and comprising a first connection point which faces a part of the first half portion of the first ½ wavelength resonance electrode, wherein said first coupling electrode is operable to electromagnetically couple with the first half portion of the first ½ wavelength resonance electrode;

a second coupling electrode in the second inter-layer portion, having a strip shape, facing the second half portion of the first ½ wavelength resonance electrode, and comprising a second connection point which faces a part of the second half portion of the first ½ wavelength resonance electrode, wherein said second coupling electrode is operable to electromagnetically couple with the second half portion of the first ½ wavelength resonance electrode;

a third coupling electrode in the second inter-layer portion, having a strip shape, facing the first half portion of the second ½ wavelength resonance electrode, and comprising a third connection point which faces a part of the first half portion of the second ½ wavelength resonance electrode, wherein said third coupling electrode is operable to electromagnetically couple with the first half portion of the second ½ wavelength resonance electrode;

a fourth coupling electrode in the second inter-layer portion, having a strip shape, facing the second half portion of the second ½ wavelength resonance electrode, and comprising a fourth connection point which faces a part of the second half portion of the second ½ wavelength resonance electrode, wherein said fourth coupling electrode is operable to electromagnetically couple with the second half portion of the second ½ wavelength resonance electrode.

2. A wireless communication module, comprising:

an RF module comprising a bandpass filter according to claim 1; and a base band module connected to the RF module.

3. The bandpass filter according to claim 1, further comprising an annular ground electrode on the first inter-layer portion, surrounding the first ½ wavelength resonance electrode, the second ½ wavelength resonance electrode, the first ¼ wavelength resonance electrode and the second ¼ wavelength resonance electrode, and connected to the ground end of the first ¼ wavelength resonance electrode and the ground end of the second ¼ wavelength resonance electrode.

4. The bandpass filter according to claim 3, further comprising:

a first auxiliary resonance electrode electrically connected to a first of the two open ends of the first ½ wavelength resonance electrode, and facing a part of the annular ground electrode; and a second auxiliary resonance electrode electrically connected to a first of the two open ends of the second ½ wavelength resonance electrode, and facing a part of the annular ground electrode;

a second ground electrode facing the open end of the first ¼ wavelength resonance electrode.

5. The bandpass filter according to claim 4, further comprising:

a third auxiliary resonance electrode electrically connected to a second of the two open ends of the first ½ wavelength resonance electrode, and facing a part of the annular ground electrode; and a fourth auxiliary resonance electrode electrically connected to a second of the two open ends of the second ½ wavelength resonance electrode, and facing a part of the annular ground electrode;

a second ground electrode facing the open end of the second ¼ wavelength resonance electrode.

6. The bandpass filter according to claim 5, further comprising:

a first auxiliary coupling electrode in a third inter-layer portion of the laminate, facing the first auxiliary resonance electrode, electrically connected to the first connecting point of the first coupling electrode;

a second auxiliary coupling electrode in the third inter-layer portion of the laminate, facing the third auxiliary resonance electrode, electrically connected to the second connecting point of the second coupling electrode;

a third auxiliary coupling electrode in the third inter-layer portion of the laminate, facing the second auxiliary resonance electrode, electrically connected to the third connecting point of the third coupling electrode; and a fourth auxiliary coupling electrode in the third inter-layer portion of the laminate, facing the fourth auxiliary resonance electrode, electrically connected to the fourth connecting point of the fourth coupling electrode.

7. The bandpass filter according to claim 6, wherein a differential signal inputted from an exterior circuit is supplied to the first coupling electrode and the second coupling electrode via the first auxiliary coupling electrode and the second auxiliary coupling electrode, and a filtered differential signal to be outputted to an exterior circuit is drawn from the third coupling electrode and the fourth coupling electrode via the third auxiliary coupling electrode and the fourth auxiliary coupling electrode.

8. A wireless communication device, comprising:

an RF module comprising a bandpass filter according to claim 1;

a base band module connected to the RF module; and an antenna connected to the bandpass filter.

* * * * *